US008678240B2

(12) United States Patent
O'Brien

(10) Patent No.: US 8,678,240 B2
(45) Date of Patent: Mar. 25, 2014

(54) DISPENSER WITH ACTUATING MEANS UNENGAGED WITH THE DISPENSING MEANS

(75) Inventor: Michael O'Brien, London (GB)

(73) Assignee: Packaging Innovation Limited, London (GB)

( * ) Notice: Subject to any disclaimer, the term of this patent is extended or adjusted under 35 U.S.C. 154(b) by 1460 days.

(21) Appl. No.: 12/226,787

(22) PCT Filed: Mar. 23, 2007

(86) PCT No.: PCT/GB2007/050150
§ 371 (c)(1),
(2), (4) Date: Oct. 27, 2008

(87) PCT Pub. No.: WO2007/125355
PCT Pub. Date: Nov. 8, 2007

(65) Prior Publication Data

US 2009/0184137 A1 Jul. 23, 2009

(30) Foreign Application Priority Data

Apr. 26, 2006 (GB) ..... 0608213.5
Dec. 22, 2006 (GB) ..... 0625538.4
Mar. 12, 2007 (GB) ..... 0704704.6

(51) Int. Cl.
*B67D 7/06* (2010.01)
*B65D 88/54* (2006.01)

(52) U.S. Cl.
USPC ..... 222/181.3; 222/190; 222/325; 222/309

(58) Field of Classification Search
USPC ..... 222/309, 190, 181.1, 181.2, 181.3, 325, 222/321.8
See application file for complete search history.

(56) References Cited

U.S. PATENT DOCUMENTS 4,238,056 A 12/1980 Tucker et al.
4,621,749 A 11/1986 Kanfer
5,033,657 A 7/1991 Whittington
5,165,577 A 11/1992 Ophardt (Continued)

FOREIGN PATENT DOCUMENTS

DE 39 11 089 A1 10/1990
EP 0 275 836 7/1988

(Continued)

OTHER PUBLICATIONS

International Search Report and Written Opinion for International application PCT/GB2007/050570, dated Jul. 23, 2008.

(Continued)

*Primary Examiner* — Kevin P Shaver
*Assistant Examiner* — Stephanie E Williams
(74) *Attorney, Agent, or Firm* — Christie, Parker & Hale, LLP

(57) ABSTRACT

A manually operated product dispenser includes a user interface which operates via a linkage mechanism on a dispensing mechanism. The linkage mechanism transfers displacement from the user interface to the dispensing mechanism but incorporates resilient means permitting the user interface to be operated to the full extent permitted by the interface, but transmitting to the dispensing mechanism only as much of the operation of the interface required to permit the dispenser mechanism to dispense a predetermined amount of product.

14 Claims, 28 Drawing Sheets

(56) References Cited

U.S. PATENT DOCUMENTS

Figure 1:
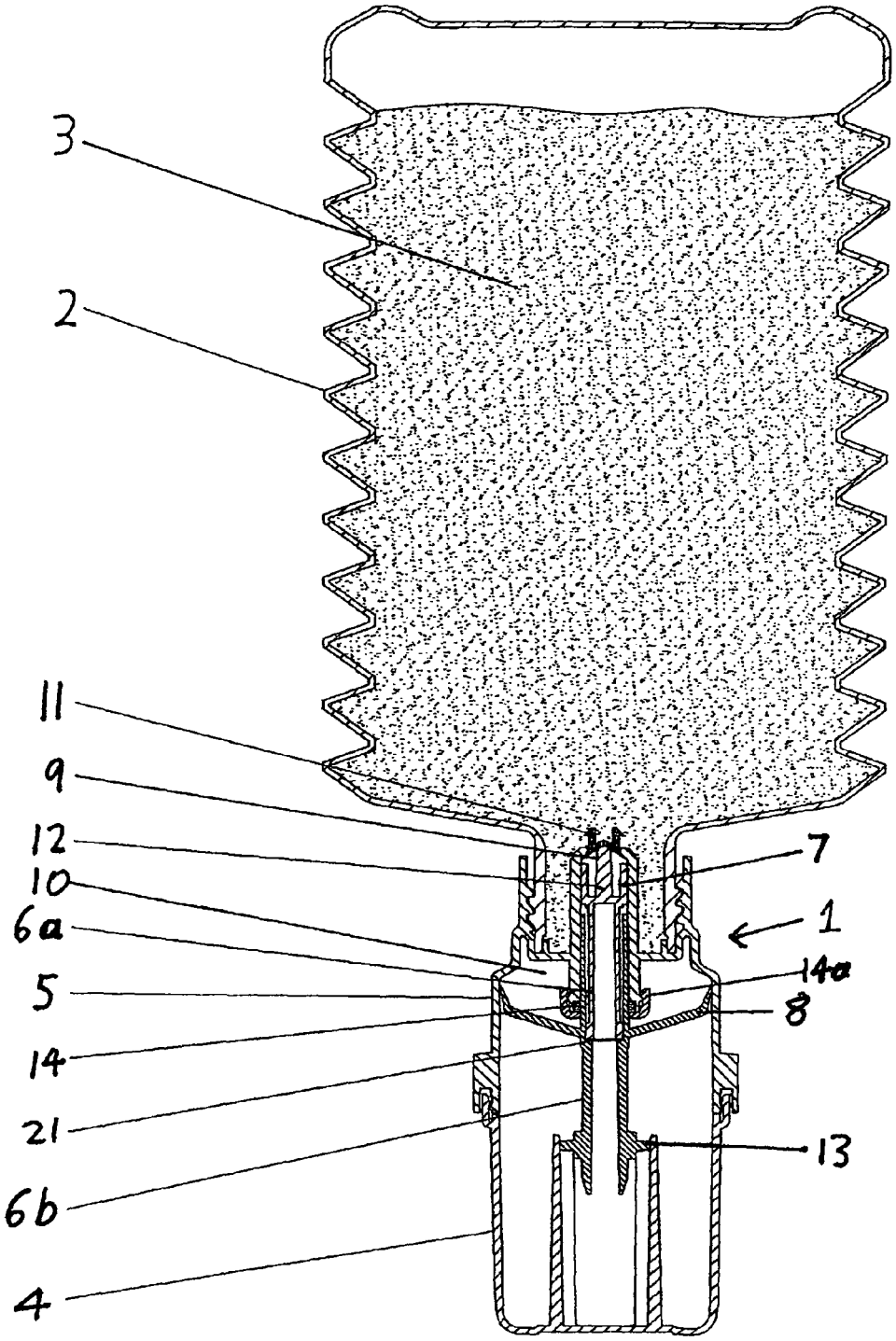

| | | | | |
|---|---|---|---|---|
| 5,265,772 | A | 11/1993 | Bartasevich et al. | |
| 5,373,970 | A * | 12/1994 | Ophardt | 222/181.2 |
| 5,431,309 | A | 7/1995 | Ophardt | |
| 5,445,288 | A | 8/1995 | Banks | |
| 5,465,877 | A | 11/1995 | Bell et al. | |
| 5,595,324 | A | 1/1997 | Brown et al. | |
| 5,779,104 | A | 7/1998 | Reidel | |
| 5,810,204 | A | 9/1998 | Devlin et al. | |
| 5,918,771 | A | 7/1999 | van der Heijden | |
| 6,131,773 | A | 10/2000 | Wade et al. | |
| 6,398,079 | B1 | 6/2002 | Garcia et al. | |
| 6,533,145 | B2 | 3/2003 | Lewis et al. | |
| 6,575,335 | B2 | 6/2003 | Lewis et al. | |
| 6,832,701 | B2 | 12/2004 | Schiller | |
| 6,877,642 | B1 | 4/2005 | Maddox et al. | |
| 7,066,357 | B2 * | 6/2006 | Ciavarella et al. | 222/156 |
| 7,086,567 | B1 * | 8/2006 | Ciavarella et al. | 222/95 |
| 7,147,133 | B2 * | 12/2006 | Brouwer et al. | 222/145.5 |
| 7,222,752 | B2 | 5/2007 | Ponton | |
| 7,225,948 | B2 * | 6/2007 | Ophardt et al. | 222/181.3 |
| 7,367,477 | B2 * | 5/2008 | Ophardt et al. | 222/181.3 |
| 7,798,370 | B2 * | 9/2010 | Ciavarella et al. | 222/181.3 |
| 2002/0074355 | A1 | 6/2002 | Lewis et al. | |
| 2002/0074356 | A1 | 6/2002 | Lewis et al. | |
| 2003/0127470 | A1 | 7/2003 | DeKoning et al. | |
| 2004/0232168 | A1 | 11/2004 | Ciavarella et al. | |
| 2005/0006408 | A1 | 1/2005 | Ganzeboom | |
| 2005/0092771 | A1 | 5/2005 | Ciavarella et al. | |
| 2005/0133537 | A1 | 6/2005 | Lewis et al. | |
| 2005/0284887 | A1 | 12/2005 | Lewis et al. | |
| 2006/0175353 | A1 | 8/2006 | Ophardt et al. | |
| 2006/0249538 | A1 | 11/2006 | Ophardt et al. | |

FOREIGN PATENT DOCUMENTS

| | | | |
|---|---|---|---|
| EP | 0 613 728 | A2 | 9/1994 |
| EP | 1 433 533 | A1 | 6/2004 |
| FR | 2 792 553 | | 10/2000 |
| GB | 818363 | | 8/1959 |
| GB | 1 447 011 | | 8/1976 |
| GB | 2 380 470 | A | 4/2003 |
| JP | 9-503161 | | 3/1997 |
| JP | 09-187692 | | 7/1997 |
| JP | 9-193953 | | 7/1997 |
| WO | WO 99/49769 | | 10/1999 |
| WO | WO 00/78629 | A1 | 12/2000 |
| WO | WO 01/81004 | A1 | 11/2001 |
| WO | WO 2005/039371 | A1 | 5/2005 |

OTHER PUBLICATIONS

International Search Report, dated Oct. 1, 2007, corresponding to PCT/GB2007/050150.

Written Opinion of the International Searching Authority, dated Oct. 1, 2007, corresponding to PCT/GB2007/050150.

WIPO Communication corresponding to priority German application 0625538.4.

International Search Report dated Apr. 20, 2007, corresponding to priority German application 0625538.4.

International Search Report dated Jun. 18, 2007, corresponding to priority German application 0704704.6.

Patent Abstracts of Japan (EPO), Publication No. 09193953, dated Jul. 29, 2007, in the name of Endo Shuzo.

English translation of Japanese Office action dated Jul. 10, 2012 issued in Japan Patent Application No. 2010-525416, 2 pgs.

U.S. Office Action dated Jun. 13, 2012 in related U.S. Appl. No. 12/678,471 (18 pages).

* cited by examiner

Figure 2a
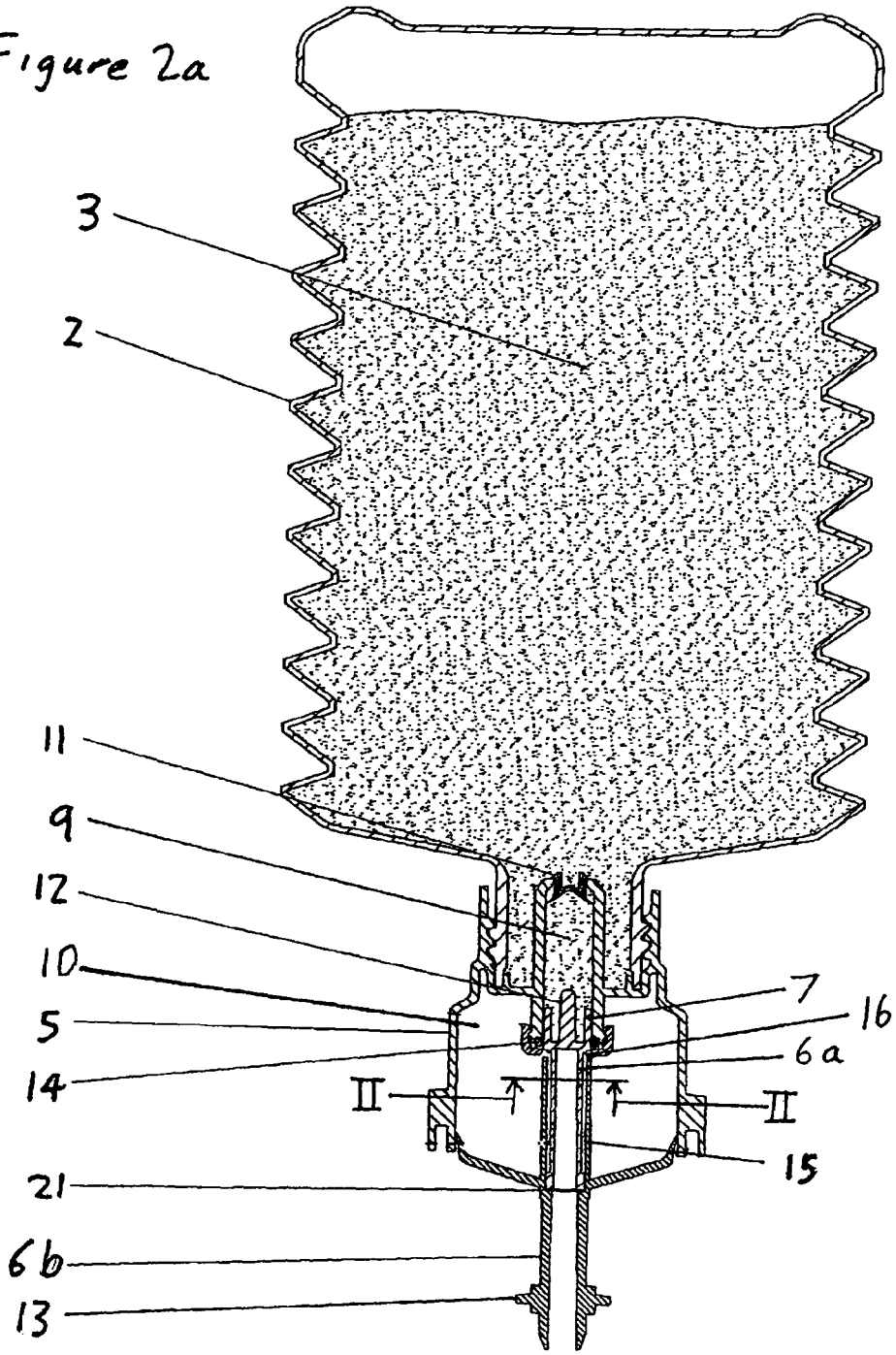
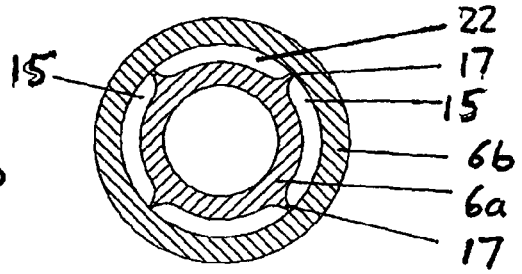
Figure 2b

Figure 3a
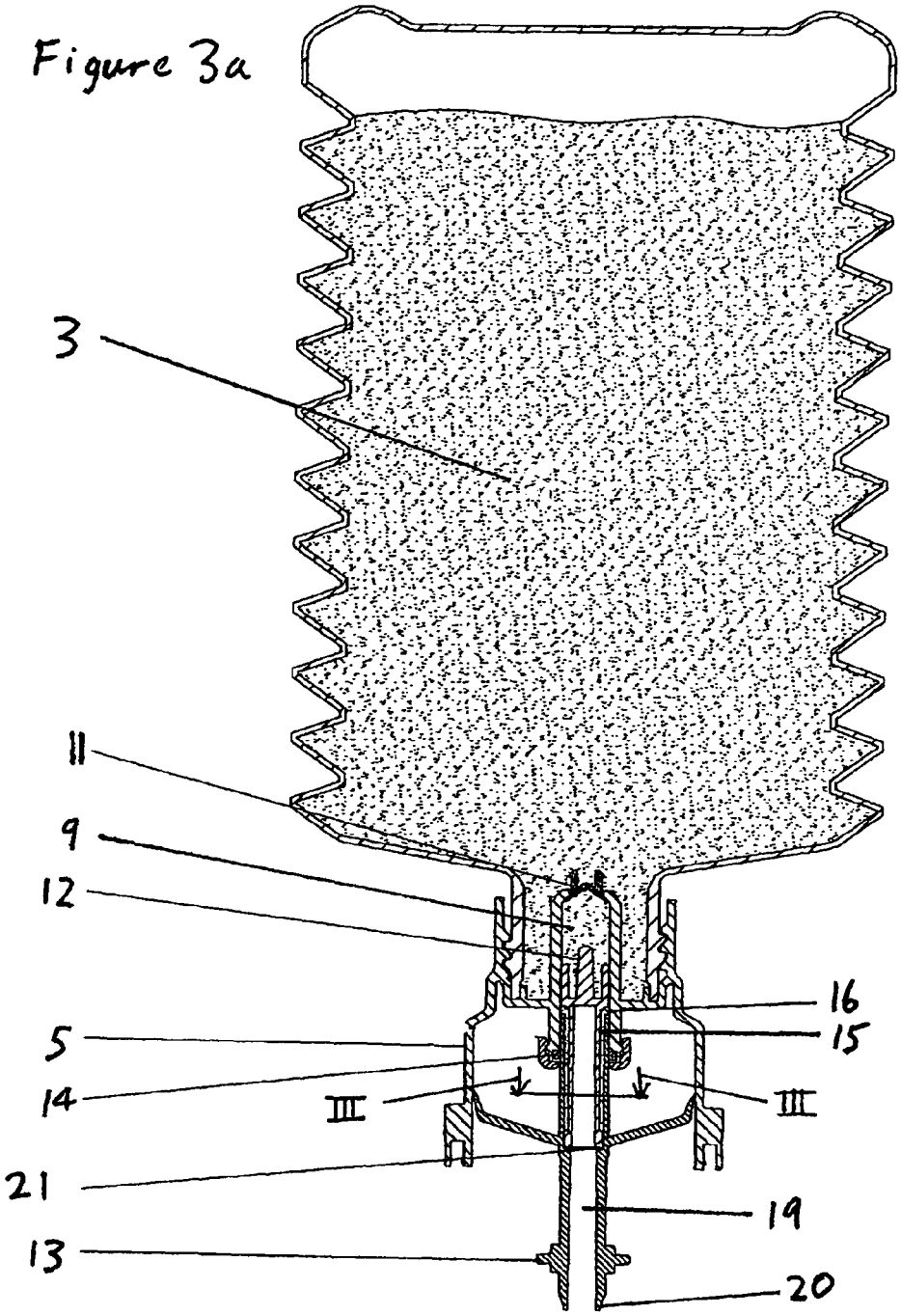
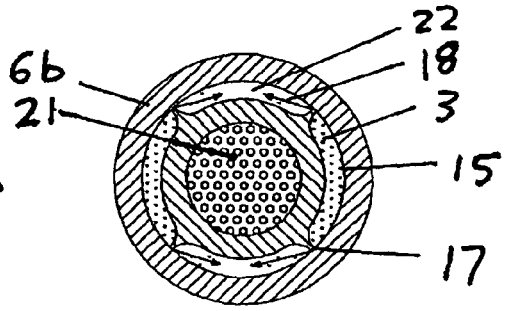
Figure 3b

Figure 4a
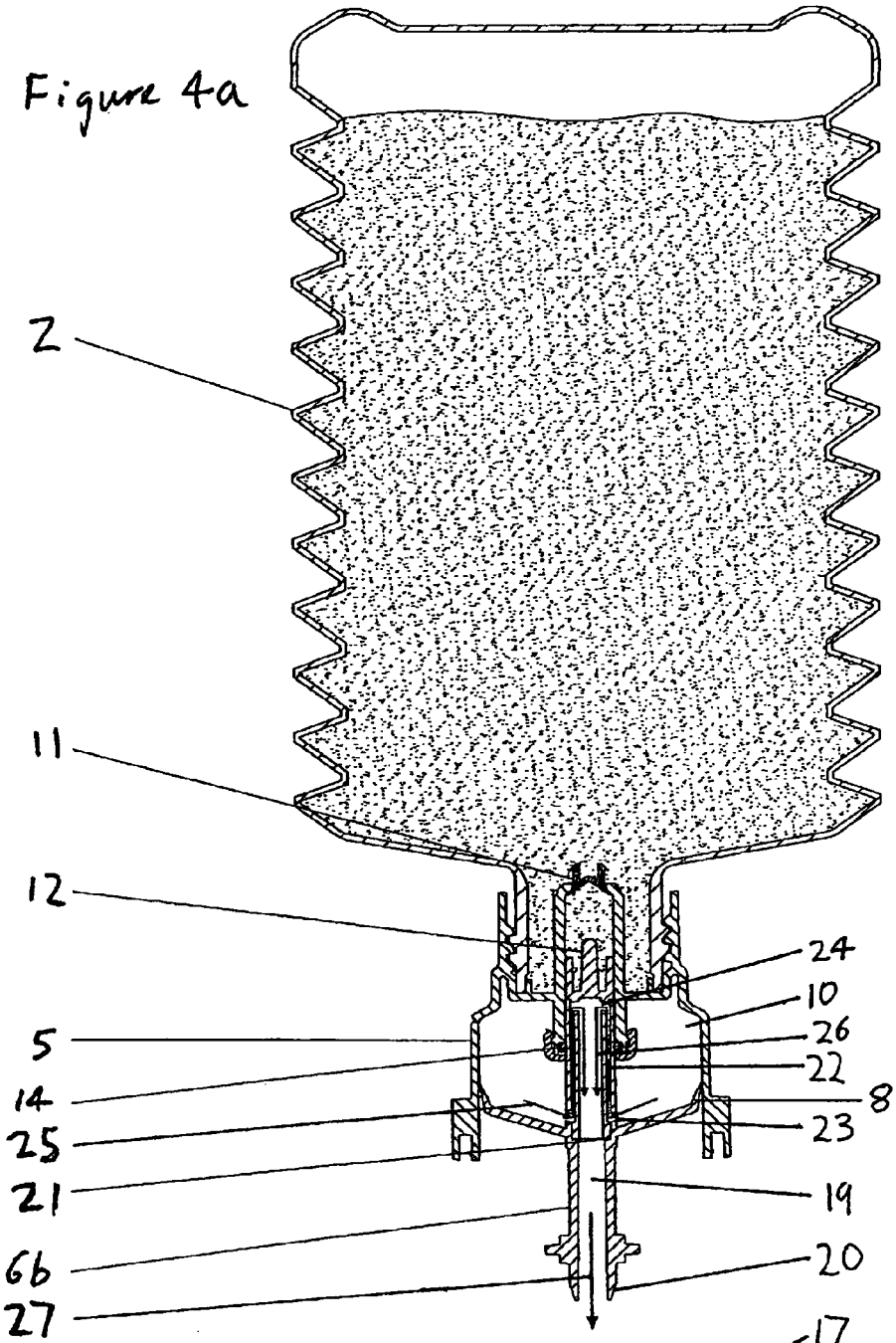
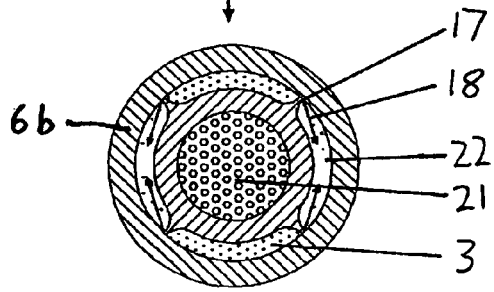
Figure 4b

Figure 5a
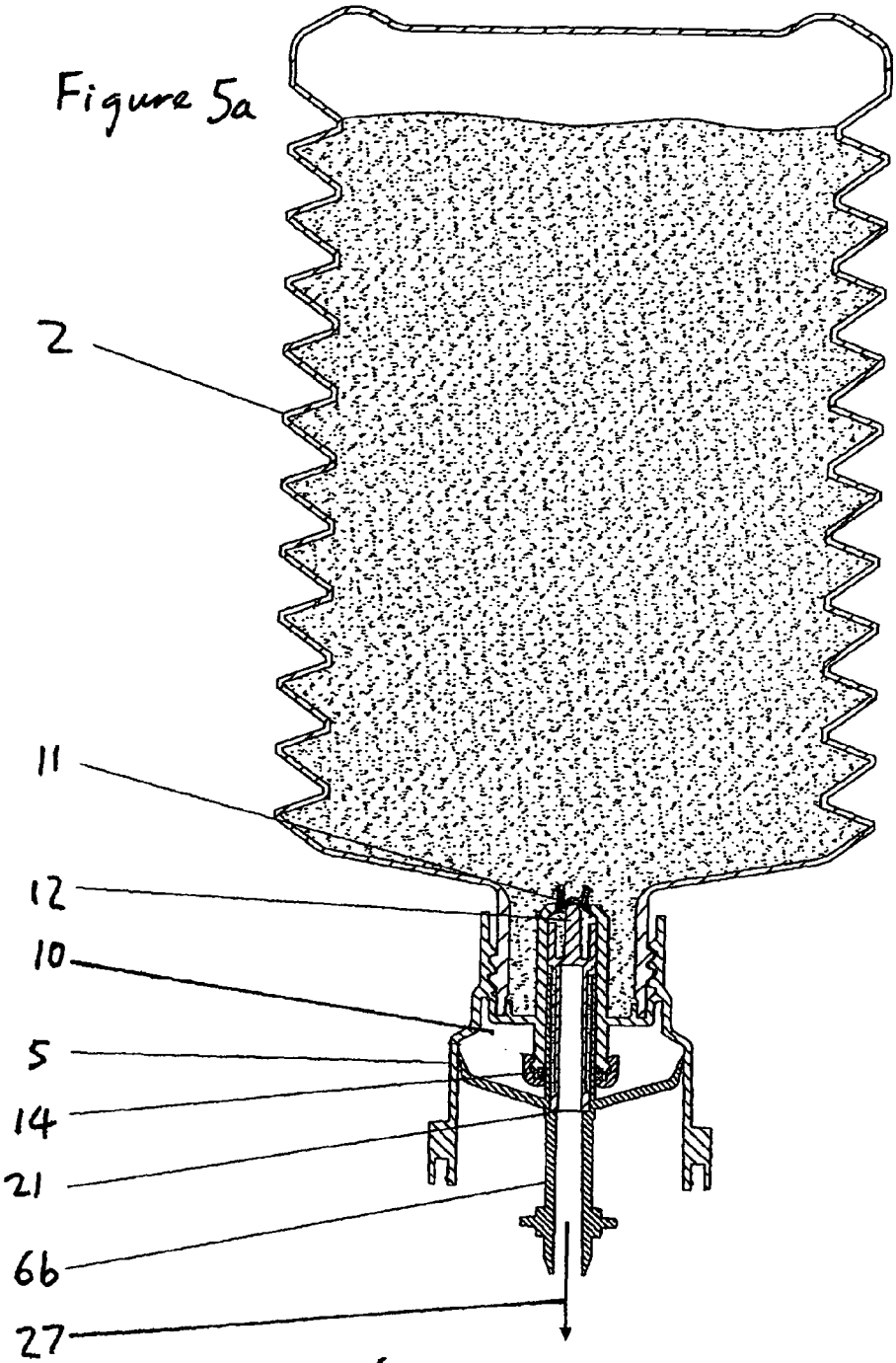
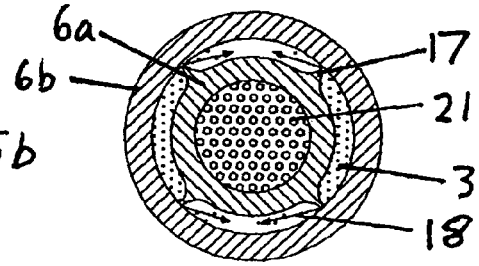
Figure 5b

AT REST

AT REST

FULL STROKE

AT REST

PART STROKE

FULL STROKE

FULL STROKE

Figure 21b
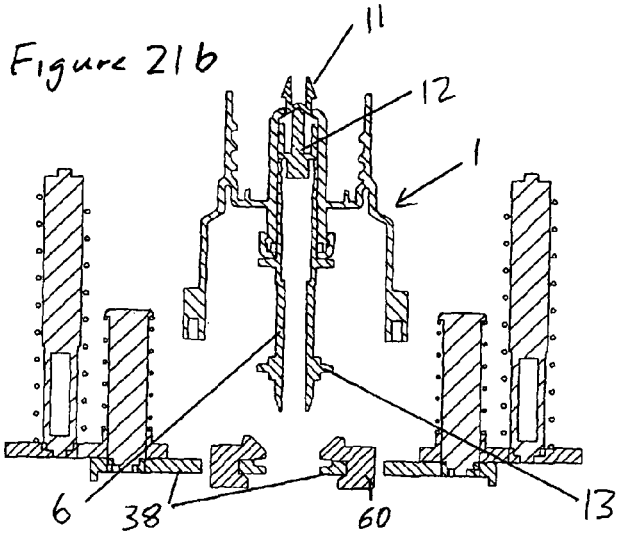
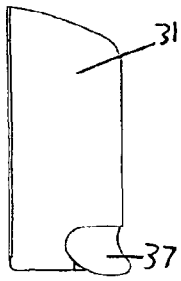
Figure 21a
Figure 22b
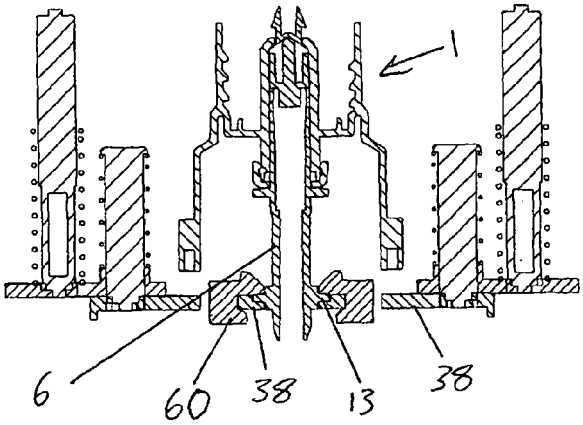
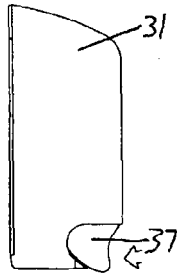
Figure 22a Figure 23b
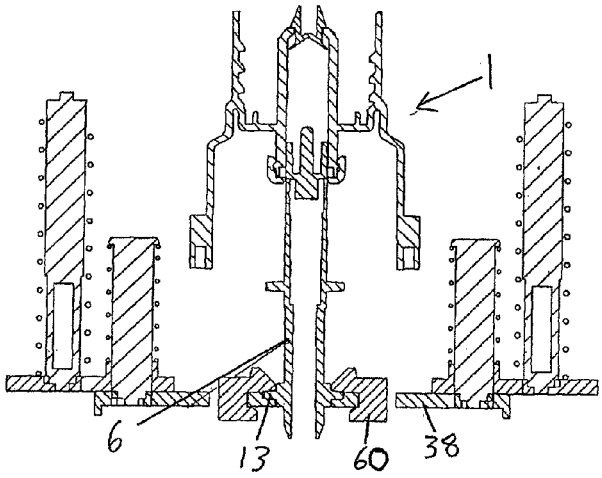
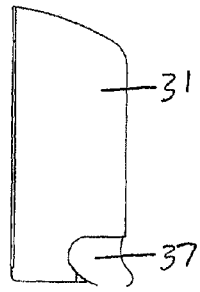
Figure 23a
Figure 24b
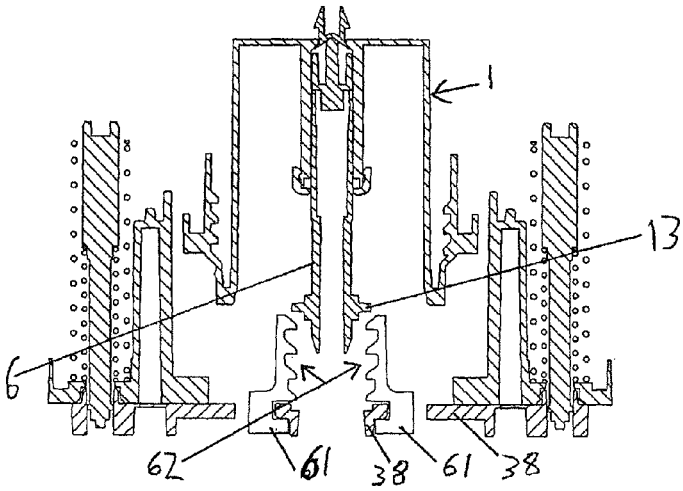
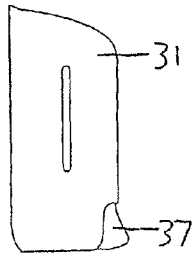
Figure 24a Figure 25b
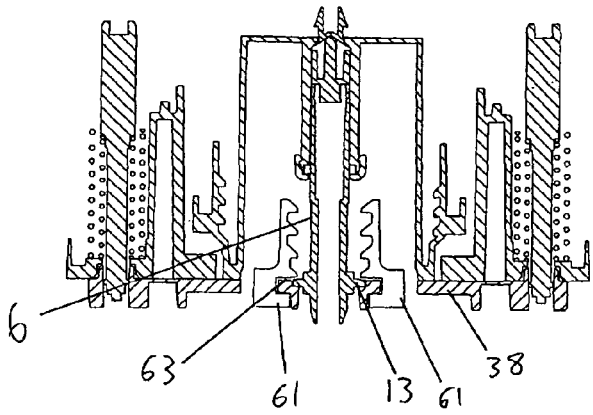
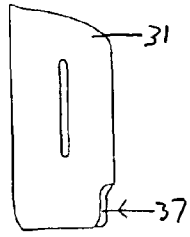
Figure 25a
Figure 26b
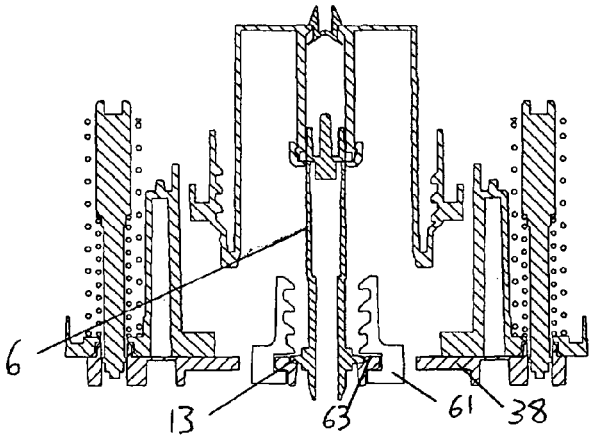
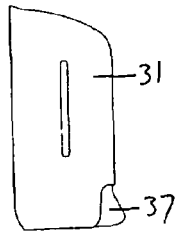
Figure 26a Figure 27b
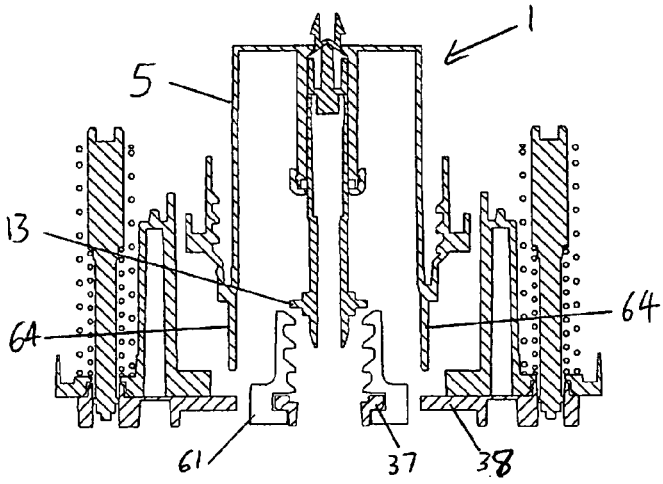
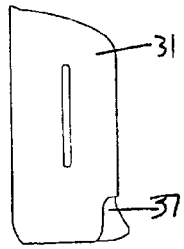
Figure 27a
Figure 28b
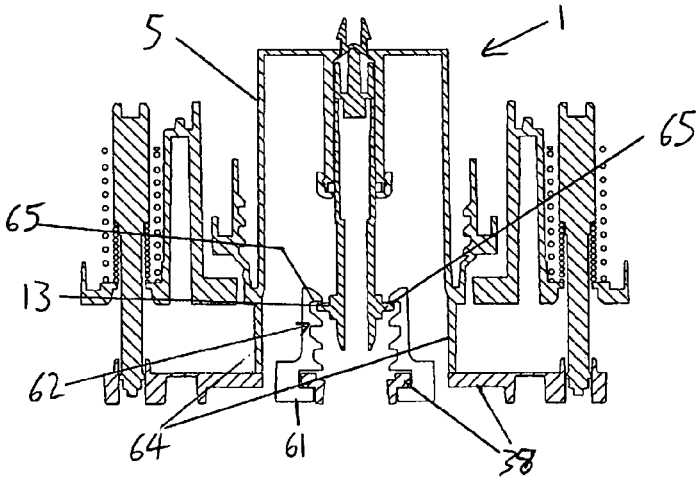
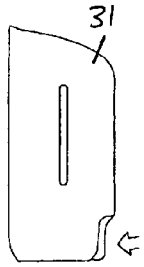
Figure 28a Figure 29b
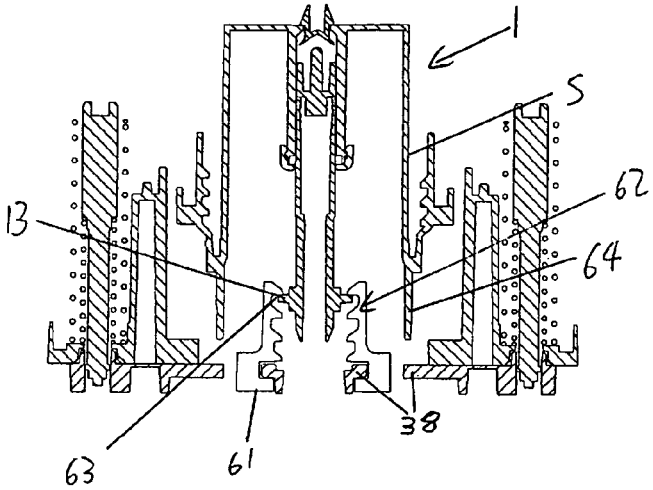
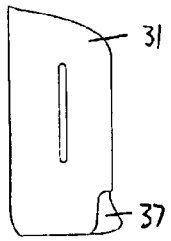
Figure 29a
Figure 30b
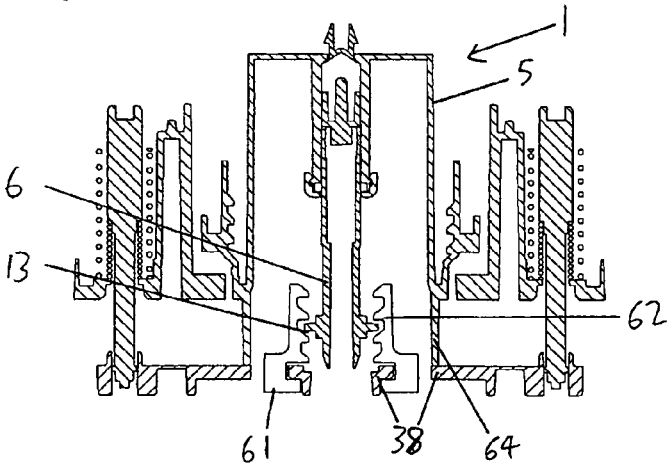
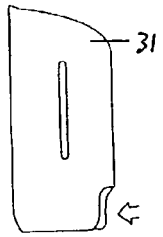
Figure 30a Figure 31b
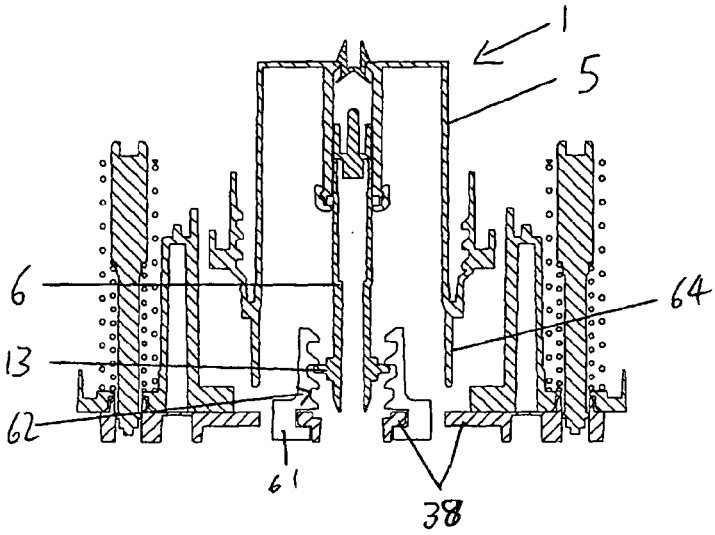
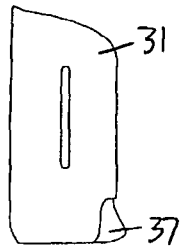
Figure 31a
Figure 32b
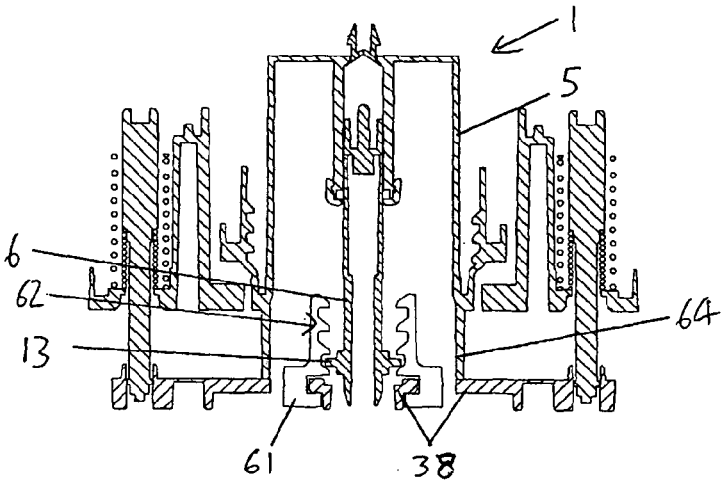
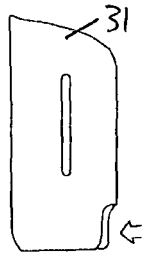
Figure 32a Figure 33b
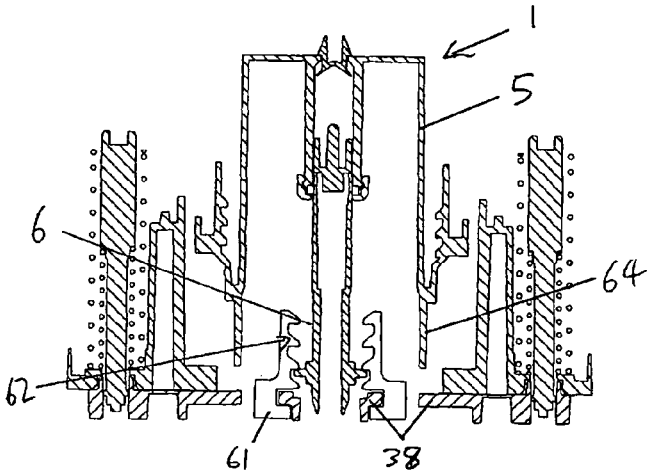
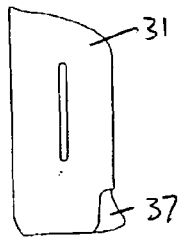
Figure 33a
Figure 34b
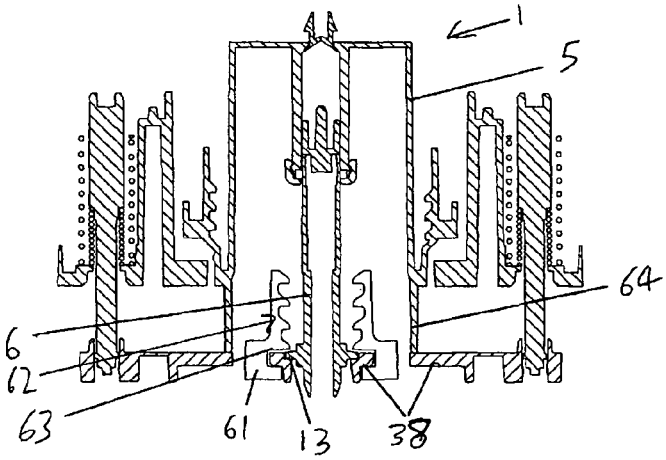
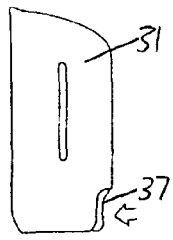
Figure 34a Figure 35b
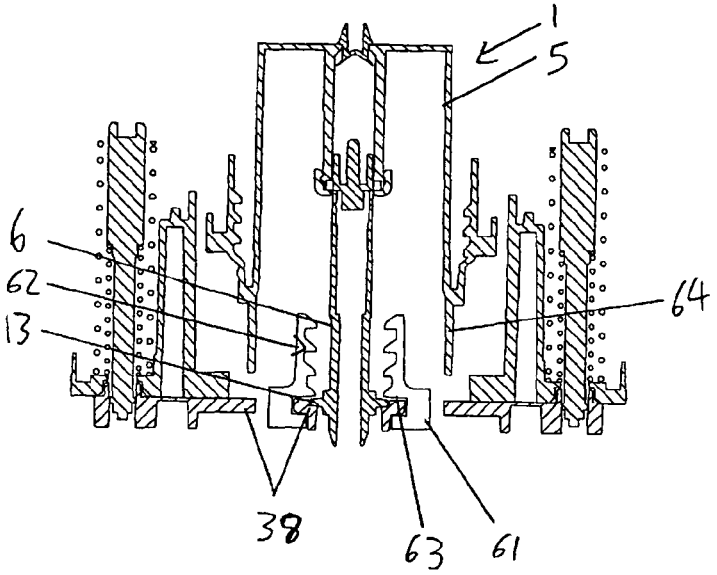
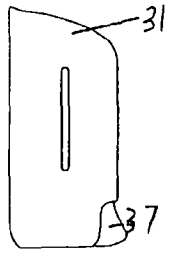
Figure 35a

DISPENSER WITH ACTUATING MEANS UNENGAGED WITH THE DISPENSING MEANS

CROSS-REFERENCE TO RELATED APPLICATION

This application is a National Phase Patent Application and claims the priority of International Application Number PCT/GB 2007/050150, filed on Mar. 23, 2007, which claims priority of British Patent Application Number 0608213.5, filed on Apr. 26, 2006, and British Patent Application Number 0625538.4, filed on Dec. 22, 2006, and British Patent Application Number 0704704.6, filed on Mar. 12, 2007.

The present invention relates to a manually operated product dispenser, particularly, but not exclusively for liquid or foamed products and more particularly relates to wall mounted soap dispensers.

Wall mounted soap dispensers traditionally dispense a liquid soap. However, with liquid soap it is necessary for the viscosity to be high enough that it can be applied to the hands without running off, enabling the soap to cling to the hands while being conveyed from under the dispenser to over the sink. Two problems associated with the high viscosity of liquid soaps is that it is necessary to dispense a relatively large quantity to enable the user to easily spread the soap over the surface of his hands and also this high viscosity tends to result in a large quantity of the soap remaining in the outlet of the dispenser, which subsequently drips onto the surface or the floor below.

In an attempt to address the above problems, soap dispensers have been developed which produce foam by mixing air with the liquid soap as it is dispensed. The action of operating the dispenser causes a soap product to be sprayed into a jet of air to produce the foam. The advantage of this is that a large quantity of foam can be produced from a relatively small volume of liquid soap, reducing the amount of liquid a user requires to satisfactorily apply the soap over his hands and such dispensers are becoming more common.

A problem that arises from having different types of soap products is that they require different types of dispenser mechanism and in some cases the same mechanism may be used but the length of actuation stroke required to dispense the desired quantity of product may differ depending on the product, or quantity of product, that is to be dispensed. This is particularly problematic in the case of commercial soap dispensers commonly found in office or restaurant environments for example. These often comprise a wall mounted unit comprising a user interface for actuating the dispenser and replaceable unit comprising a soap filled reservoir. If the customer is to have a choice of product, then because of the relatively high cost of both manufacturing and installing the wall mounted unit, it is desirable that this unit, once installed, be used for different product types. One way of conveniently achieving this is to provide a dispensing mechanism as part of the replaceable (or disposable) unit with the dispenser mechanism arranged to dispense the desired quantity of product in response to operation of the user interface on the wall mounted unit.

According to a first aspect of the present invention there is provided a manually operated product dispenser comprising a user interface for receiving a single stroke actuation by a user, a dispenser mechanism for dispensing a predetermined quantity of product to the user on a full stroke of the dispenser mechanism and a linkage mechanism for transferring displacement of the user interface to the dispensing mechanism, wherein the linkage mechanism permits the user interface to be operated to the full extent permitted by the interface and transmit to the dispenser mechanism only as much of the operation of the interface as is required to permit the dispenser mechanism to dispense the predetermined amount of product.

The term 'single stroke actuation' above does not necessarily mean that a single stroke will only be required to dispense the amount of product required by a user, but simply means that a single stroke will permit a predetermined quantity of the product to be dispensed.

This mechanism is particularly advantageous for it can be arranged to ensure that any reasonable exertion on the user interface causes the dispenser mechanism to operate fully, thus providing a predetermined volume of product, while ensuring that any excessive pressure applied to the user interface does not damage the dispenser mechanism. It can thus also permit a common user interface and linkage mechanism to be used with dispenser mechanisms having different maximum stroke lengths for dispensing different product types or volumes. It also allows a common dispenser mechanism to be adjusted to provide different product volumes by restricting the maximum stroke length.

Advantageously, the linkage mechanism comprises a resilient device between the interface and dispenser mechanism, the properties of the resilient device being sufficient to fully activate the dispenser mechanism an operation of the interface but which resilient device absorbs any further movement of the interface to prevent damage to the dispenser mechanism.

Preferably, the linkage mechanism comprises a first plate connected to the user interface and arranged to move with the user interface, a second plate connected to the dispenser mechanism, and at least one resilient member arranged to act between the first plate and the second plate, the resilient member being selected such that it will cause the two plates to be displaced together in response to any movement of the user interface to cause the dispenser mechanism to be operated but which, when the dispenser mechanism reaches the end of its travel, permits the first plate to continue to be displaced whilst the second plate remains substantially stationary.

Advantageously, the dispenser comprises a main unit including the linkage mechanism and a replaceable unit, the replaceable unit containing product to be dispensed and including the dispenser mechanism, wherein the linkage mechanism permits the main unit to be used with dispenser mechanisms having different maximum stroke lengths. This arrangement permits replaceable units containing a product to have an appropriate dispenser mechanism for that product attached thereto, which replaceable units can then be installed in the main unit with the user interface and linkage mechanism permitting the dispensing mechanism, forming part of the replaceable unit to be correctly operated for a number of replaceable unit types having different maximum stroke lengths.

It is particularly advantageous if the dispenser includes a ratchet mechanism arranged such that, after installation of a new replaceable unit having a dispenser mechanism with a particular maximum stroke length, the ratchet mechanism will, on subsequent operations of the user interface, cause the linkage mechanism to progressively engage with the dispensing mechanism unit until the dispenser mechanism adopts a correct operating position relative to the linkage mechanism, whereby operation of the user interface causes the dispenser mechanism to perform a desired stroke.

The term 'ratchet mechanism' as used in the context of the present specification covers any mechanism which performs a ratchet effect, that is to say which engages on operation in one direction and disengages on operation in the opposite direction.

According to a second aspect of the invention, there is provided a manually operated product dispenser comprising: a main unit housing a user interface for receiving a single stroke actuation by a user and a linkage mechanism; and a replaceable unit for storing product to be dispensed and having a dispenser mechanism for dispensing a quantity of product on actuation of the user interface, wherein the linkage mechanism is arranged to transfer displacement of the user interface to the dispensing mechanism, the dispenser including a ratchet mechanism arranged such that after installation of a new replaceable unit having a dispenser mechanism with a particular maximum stroke length the ratchet mechanism will, on subsequent operations of the user interface, cause the linkage mechanism to progressively engage with the dispensing mechanism so that the dispenser mechanism adopts a correct operating position relative to the linkage mechanism, whereby operation of the user interface causes the dispenser mechanism to perform a desired stroke.

The ratchet mechanism may form part of the linkage mechanism wherein the dispenser mechanism comprises an engagement point which is engaged by one or more surfaces of the linkage mechanism, which surfaces form the ratchet and said engagement point may be on the nozzle of the dispensing mechanism which nozzle forms a dispensing nozzle of the dispenser. However, the ratchet mechanism could alternatively be formed as part of the dispenser mechanism which engages with the linkage mechanism.

The invention in accordance with the second aspect of the invention may be particularly advantageously employed for dispensing foam products where the dispensing mechanism mixes liquid product with air, for such dispensing mechanisms often require the dispensing cycle to start with the dispensing mechanism at a fully extended, primed state.

This second aspect of the invention is particularly advantageous where a number of types of replaceable units can be used with a common main unit, the replaceable units comprising dispenser mechanisms which are substantially the same as each other but wherein at least some of the dispenser mechanism include a stop member to provide different dispenser mechanisms with different maximum stroke lengths. This enables the replaceable units to be arranged to be transported in a closed state and then, in operation, to extend to a primed state wherein the dispenser mechanism is fully extended against the stop member.

The above arrangement permits a common dispenser mechanism, with common components, to be used to dispense a product, particularly a foam product such as foamed soap and enables the common dispenser mechanism to have different stroke lengths to dispense different product types or different product volumes, by simply employing stop members located at different locations. The ratchet mechanism ensures that after installation of the replaceable unit, regardless of the type of dispenser mechanism, operation of the user interface of the main unit will eventually cause the dispenser mechanism to adopt the correct primed state prior to the start of a dispensing cycle.

As described above, the invention may advantageously be employed with a foam-type dispenser. The dispenser mechanism may then advantageously comprise a liquid chamber arranged to receive a liquid product; an air chamber arranged to receive air; an actuator mechanism arranged to simultaneously pressurise the contents of both the liquid and air chambers; a foaming chamber; and at least one fin element separating an open portion of the foaming chamber from a closed portion of the foaming chamber, wherein the dispenser mechanism is arranged such that operation of the actuator mechanism causes the open portion to receive air from the air chamber and guide it to an outlet of the dispenser mechanism and the closed portion to simultaneously received pressurised liquid from the liquid chamber, the at least one fin element being dimensioned such that liquid in the closed portion is forced, under pressure, past the tip of the fin element to the open portion where it is mixed with air flowing in the open portion to form a foamed product.

Both the first and second aspect of the present invention find particularly applications to wall-mounted soap dispensers.

Figure 8:
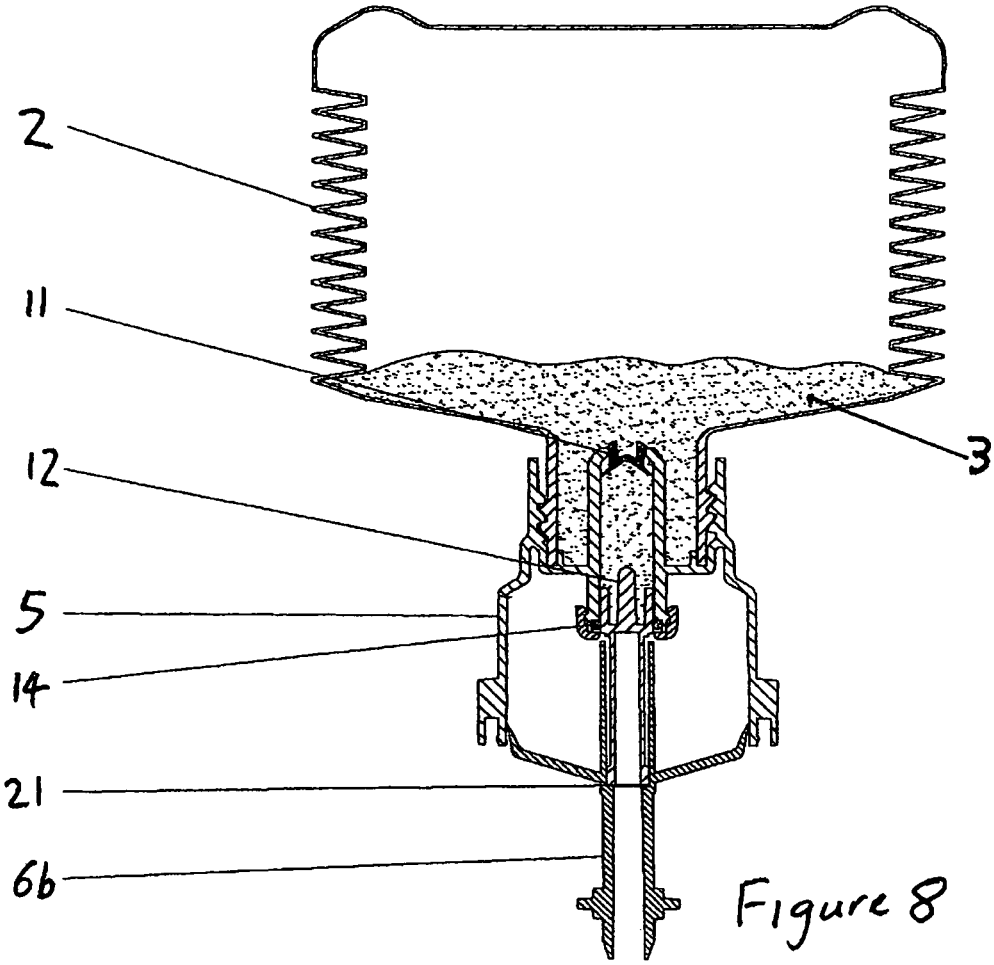
Figure 9:
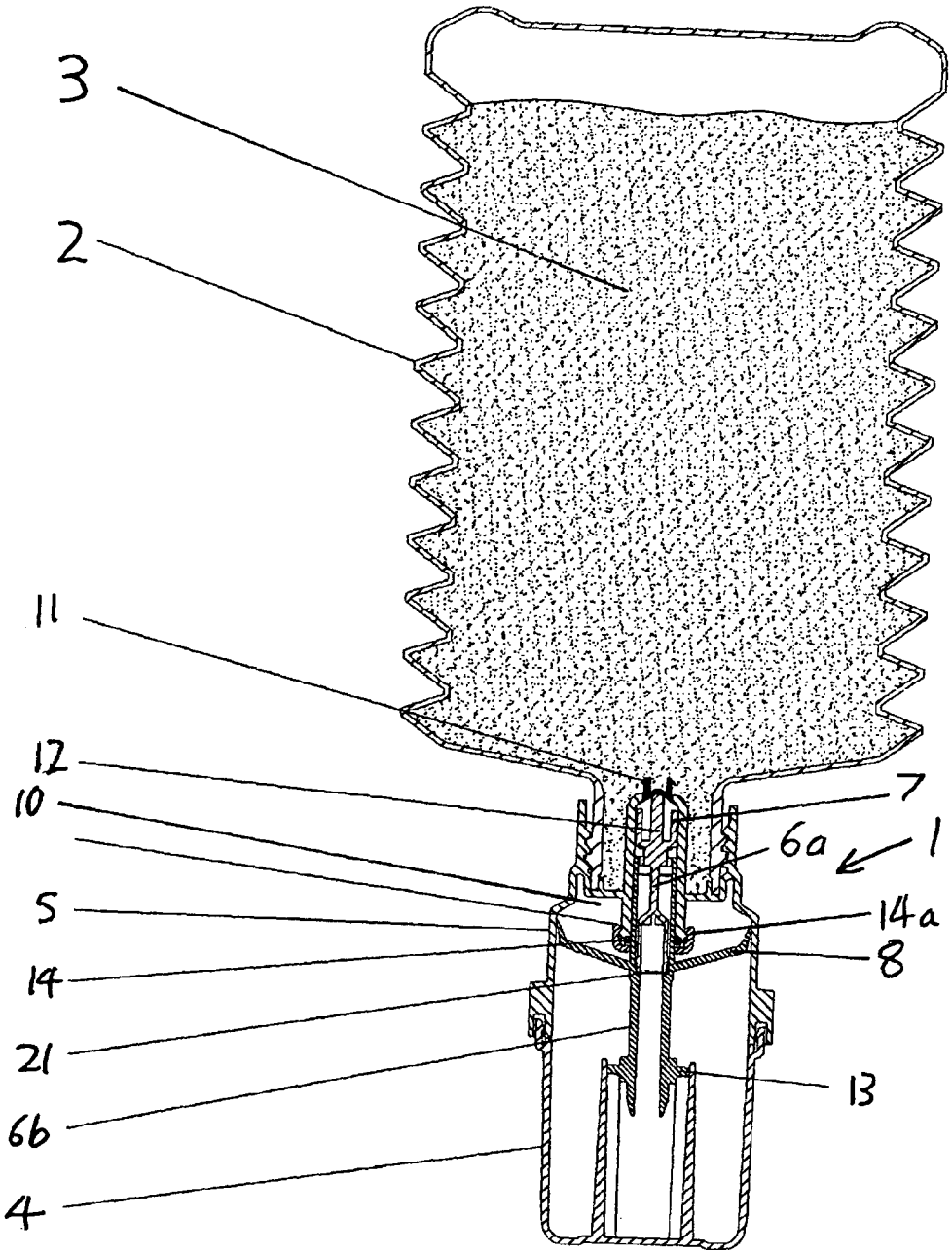

The present invention will now be described, by way of example only, with reference to the accompanying drawings, in which like numerals are used throughout to indicate like parts, and in which:

FIG. 1 is a cross-section through a first dispensing mechanism which may be employed in a product dispenser in accordance with the present invention, with a transport cap in place;

FIG. 2*a* is a corresponding cross-section to that of FIG. 1 but with the transport cap removed;

FIG. 2*b* is a section along the line II-II of FIG. 2*a*, shown to an enlarged scale;

FIGS. 3*a*, 3*b*, 4*a*, 4*b*, 5*a*, 5*b*, 6*a*, 6*b*, 7*a* and 7*b* are sectional views respectively corresponding to those of FIGS. 2*a* and 2*b*, but depicting the various stages of operation of the dispensing mechanism;

FIG. 8 depicts how the liquid container collapses as liquid is dispensed;

FIG. 9 is a cross-section through a second dispensing mechanism which may be used in a product dispenser in accordance with the present invention, which dispenser mechanism has a modified foaming chamber to that of the embodiment illustrated in FIGS. 1 to 8. However, in all other respects the dispenser mechanism is identical and like numerals are used to indicate corresponding parts to those in FIGS. 1 to 8.

Figures 10A, 10B:
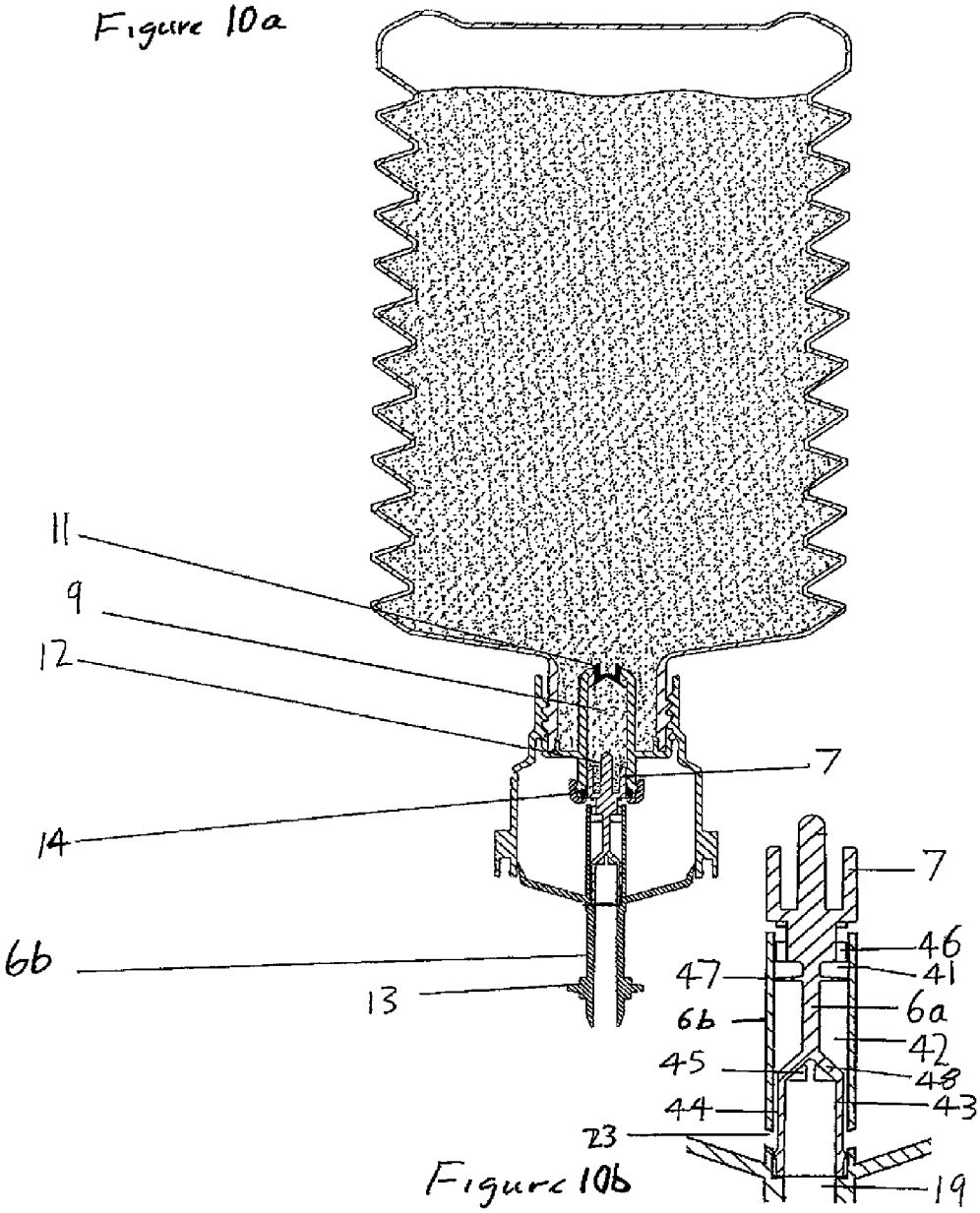

FIGS. 10*a* and 10*b* are a cross-section and a selectively enlarged cross-section, respectively, of the dispenser of FIG. 9, illustrating a stage of operation of the dispenser mechanism.

Figure 11:
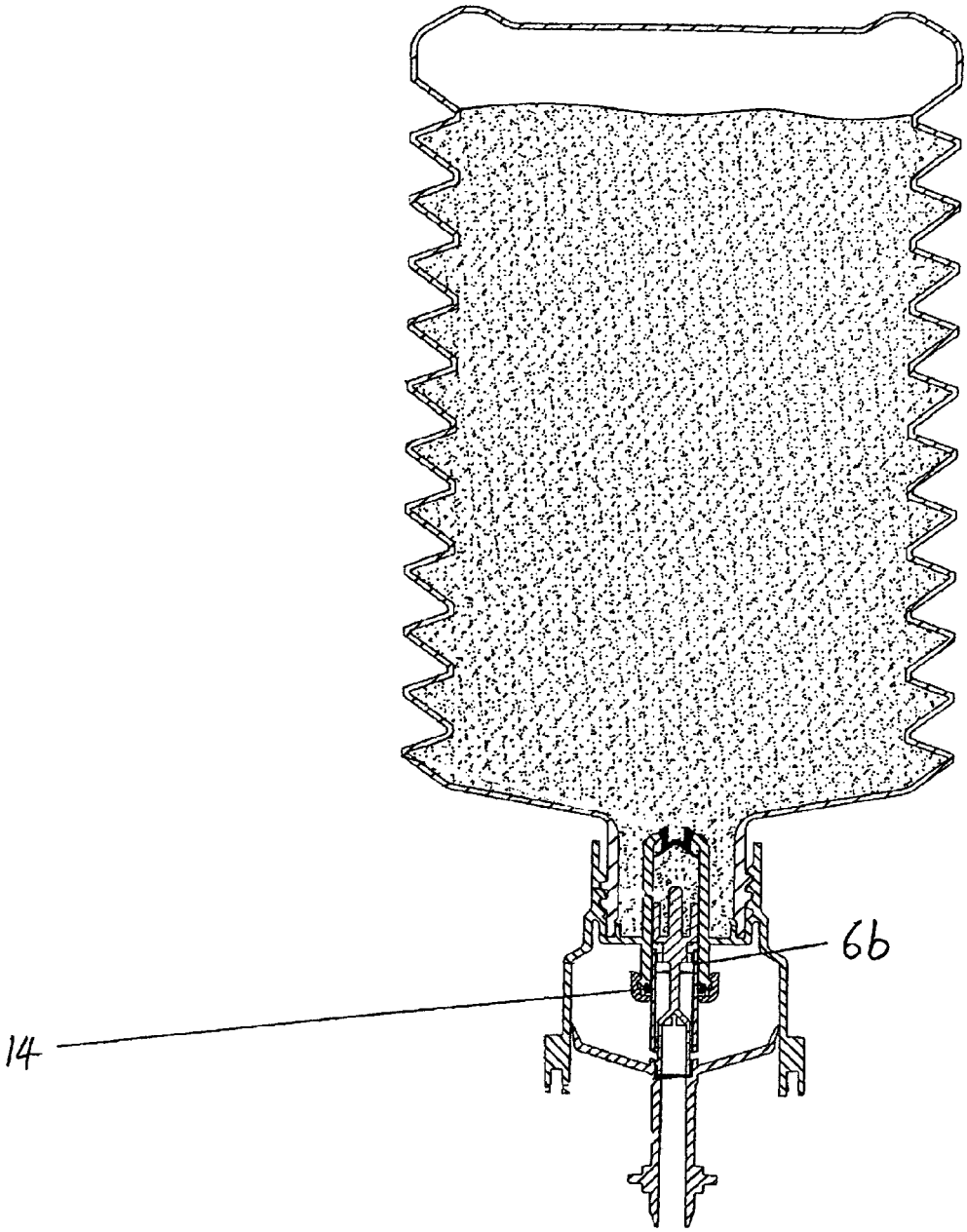

FIG. 11 is a cross-section of the dispenser of FIG. 9, illustrating a stage of operation of the dispenser mechanism.

FIGS. 12*a* and 12*b* are a cross-section and a selectively enlarged cross-section, respectively, of the dispenser of FIG. 9, illustrating a stage of operation of the dispenser mechanism.

Figures 13A, 13B:
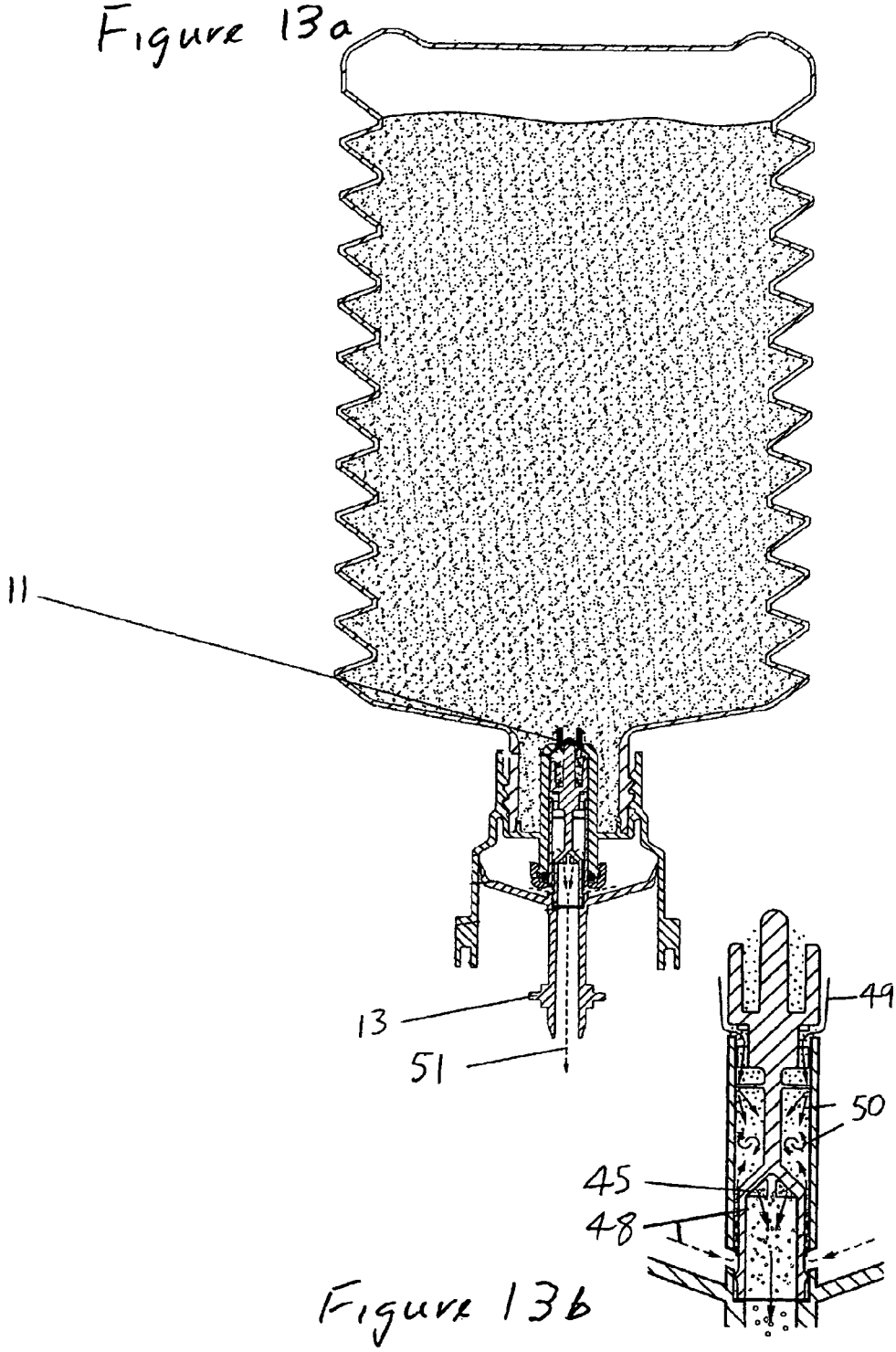

FIGS. 13*a* and 13*b* are a cross-section and a selectively enlarged cross-section, respectively, of the dispenser of FIG. 9, illustrating a stage of operation of the dispenser mechanism.

Figures 14A, 14B:
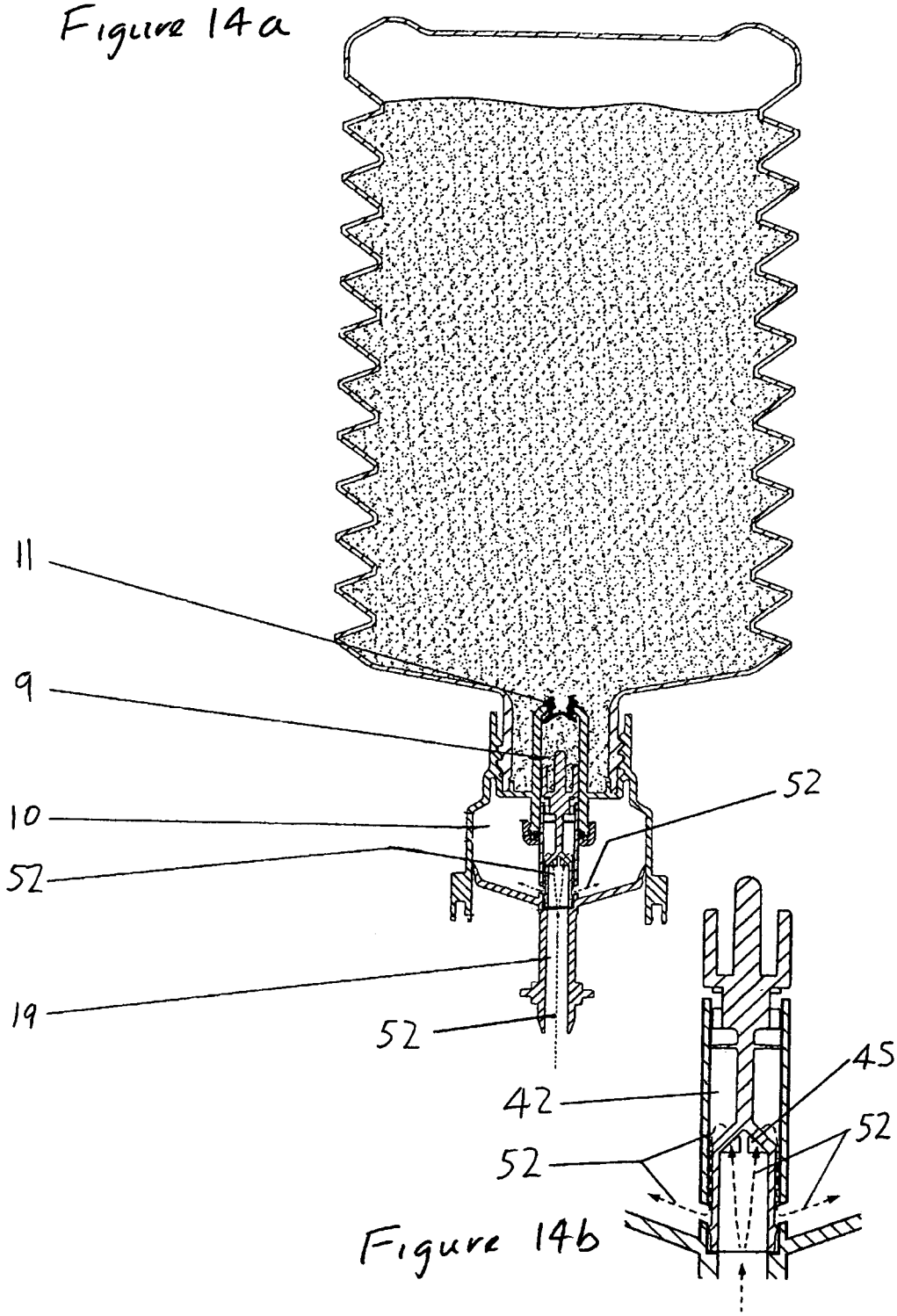

FIGS. 14*a* and 14*b* are a cross-section and a selectively enlarged cross-section, respectively, of the dispenser of FIG. 9, illustrating a stage of operation of the dispenser mechanism.

Figure 15:
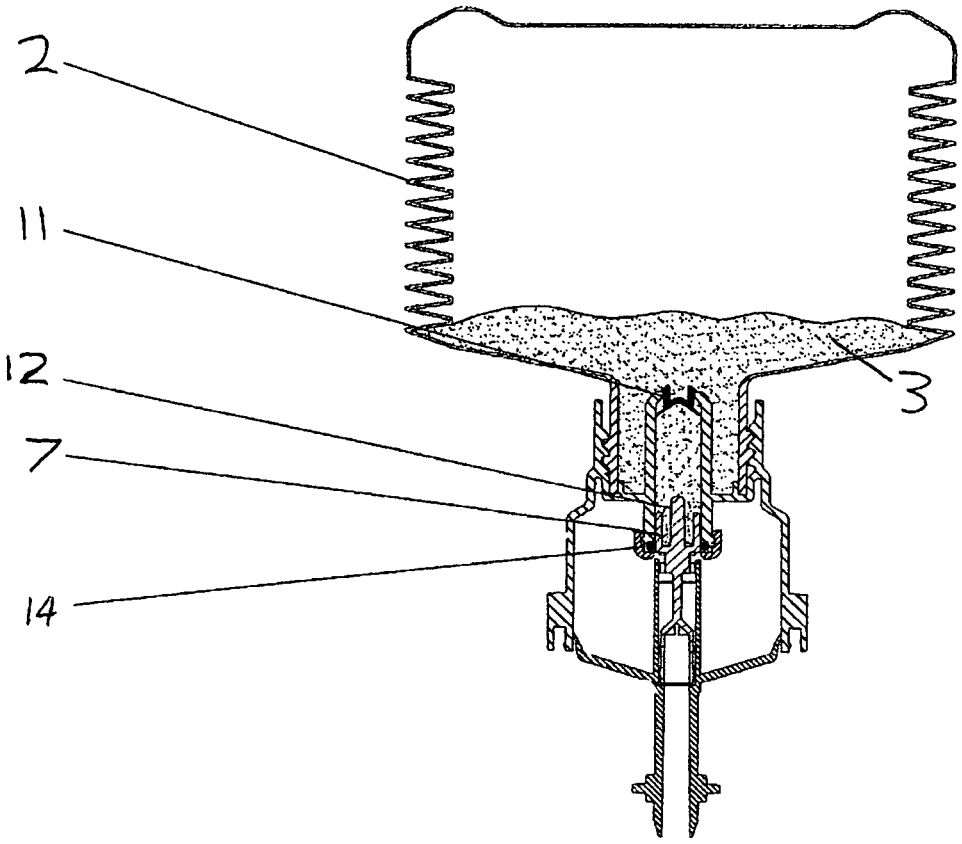

FIG. 15 is a cross-section of the dispenser of FIG. 9, illustrating a stage of operation of the dispenser mechanism.

Figure 16A:
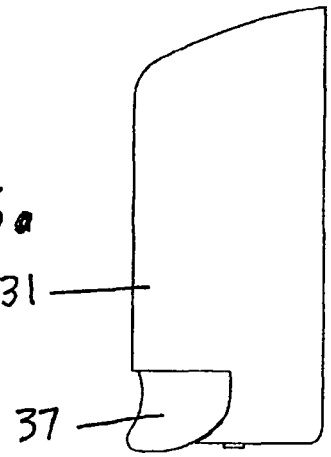
Figure 16B:
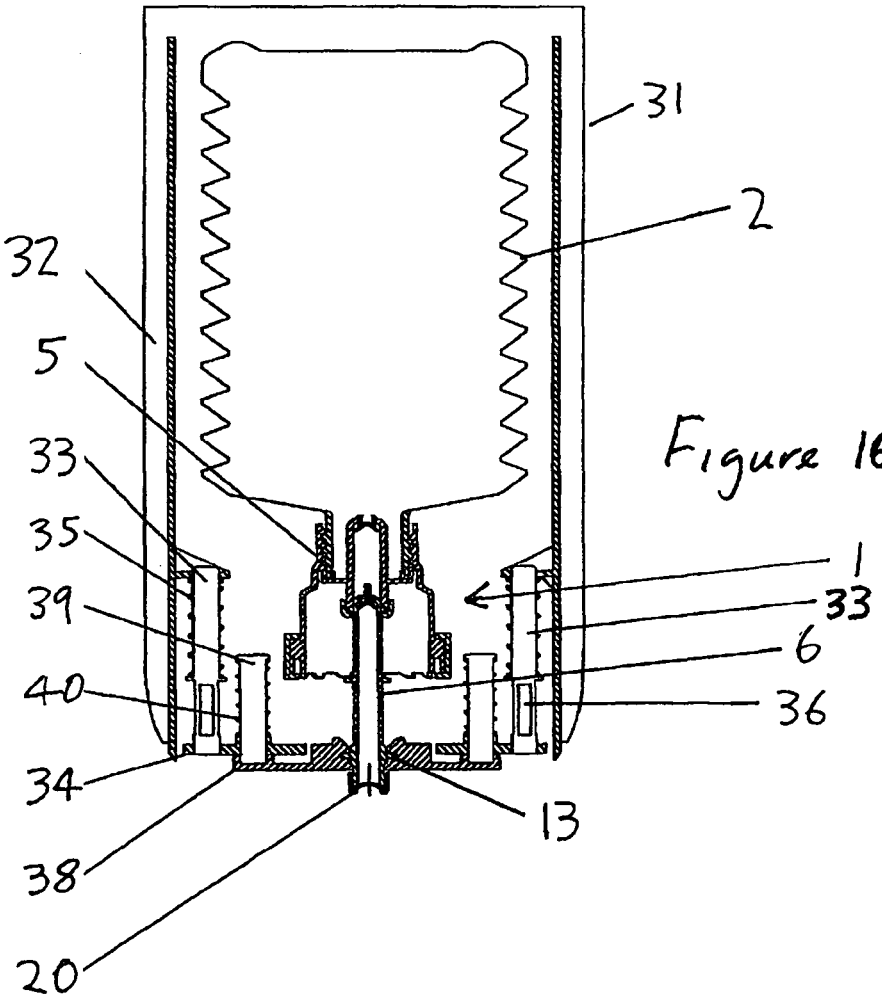
Figure 17A:
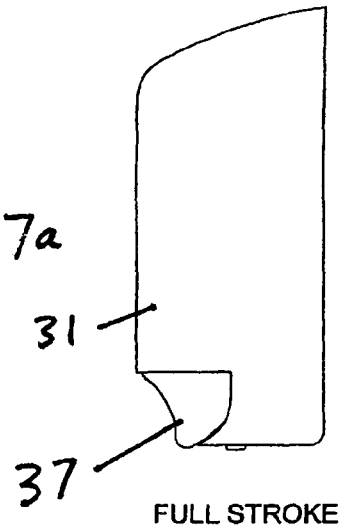
Figure 17B:
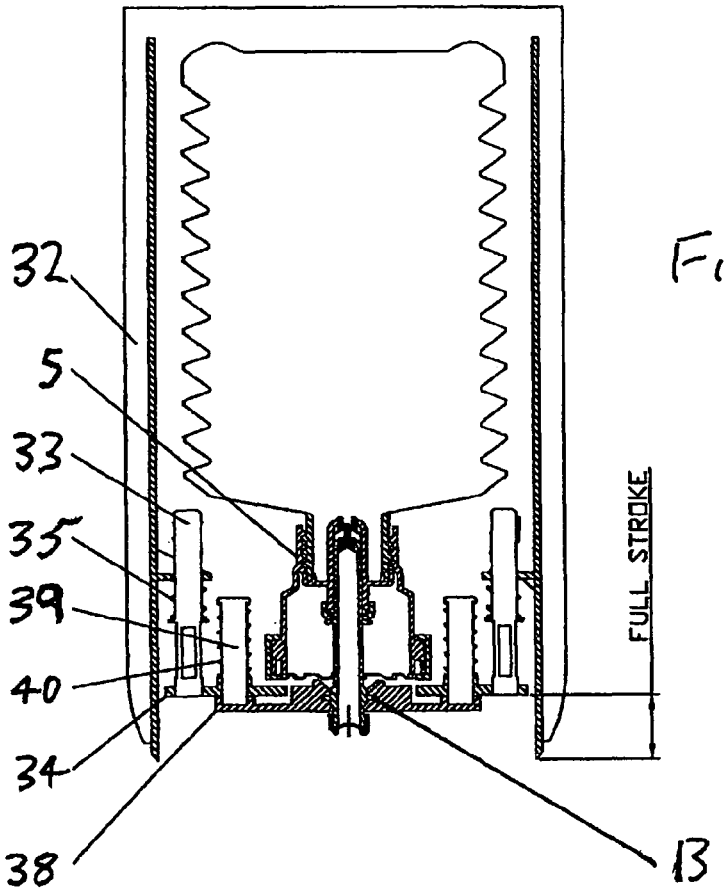

FIG. 16*a* is a side elevation of a product dispenser in accordance with a first aspect of the present invention, incorporating the dispenser mechanism of either FIGS. 1 to 8 or 9 to 5;

FIG. 16*b* is a front sectional view of the dispenser of FIG. 16*a;*

FIGS. 17*a*, 17*b*, 18*a*, 18*b*, 19*a*, 19*b*, 20*a* and 20*b* corresponding to those of FIGS. 16*a* and 16*b* but depict the dispenser in various stages of operation;

FIG. 21*a* is a side elevation of a product dispenser in accordance with the first aspect of the present invention incorporating the dispenser mechanism of either FIGS. 1 to 8 or 9 to 15;

FIG. 21*b* is a front sectional view of the dispenser of FIG. 21*a;*

FIGS. 22*a*, 22*b*, 23*a* and 23*b* correspond to those of FIGS. 21*a* and 21*b* but depict the dispenser in various stages of operation;

FIG. 24*a* is a side elevation of a product dispenser in accordance with both the first and second aspects of the present invention incorporating the dispenser mechanism of either FIGS. 1 to 8 or 9 to 15;

FIG. 24*b* is a front sectional view of the dispenser of FIG. 24*a;*

FIGS. 25*a* to 35*b* correspond to those of FIGS. 24*a* to 24*b* but depict the dispenser in various stages of operation.

Referring to FIG. 1, there is illustrated a dispenser mechanism 1 in accordance with the present invention connected to a disposable collapsible container 2 filled with liquid soap 3. The container 2 and dispenser mechanism 1 are replaceable as a unit and are intended to be disposable, that is to say they are provided as a refill pack for a wall mounted soap dispenser.

Because in the particular embodiment illustrated in FIG. 1 the dispenser mechanism is disposable and is thus transported attached to the filled container 2. The dispenser mechanism comprises a transport cap 4, secured to the housing 5 of the dispenser mechanism.

The dispenser mechanism comprises an inner shaft 6*a* and an outer shaft 6*b* (together hereinafter referred to as shaft 6), an upper portion of inner shaft 6*a* defines a first piston 7 and a lower portion of outer shaft 6*b* supporting a second piston 8, mounted coaxially on the outer shaft 6*b*.

The first piston 7, together with the housing 5, defines a first chamber 9, with the second piston 8 defining with the housing 5 a second chamber 10.

In the top of the first chamber 9 there is an opening, in which opening there is located a non-return valve 11. This permits liquid soap 3 to flow from the container 2 to the first chamber 9.

When the transport cap is in place, as shown in FIG. 1, the shaft 6 and associated piston 7 and 8 are retained in a fully depressed, position whereby a pin 12, extending from the centre of the first piston 7, engages with the non-return valve 11 to keep it in a closed position, as shown. This ensures that during transit, fluid cannot leak from the container 3 through the dispenser mechanism 1.

Referring now to FIG. 2*a*, a corresponding view to that of FIG. 1 is shown but with the transport cap 4 removed. When the transport cap has been removed and the dispenser mechanism installed in a dispenser (as described below with reference to FIGS. 9*a* to 13*b*) the mechanism of the dispenser, not shown in FIG. 2*a*, biases flange 13 located towards the bottom of outer shaft 6*b* to the position shown in FIG. 2*a*. Here a rubber O-ring seal 14 seals with the first piston 7. The O-ring 14 is retained in place by end cap 14*a*. Drawing the shaft 6 downwards causes liquid soap 3 to flow into the first chamber 9.

As most clearly seen in FIG. 2*a*, the inner shaft 6*a* and outer shaft 6*b* define channels which are sealed at the bottom portion, where the inner shaft 6*a* is joined to the outer shaft 6*b* and thus only have apertures 16 at the top thereof. These are hereinafter referred to as closed channels 15.

As can be more clearly seen from FIG. 2*b*, a cross-section through the plane II-II of FIG. 2*a*, closed channels 15 are defined by the inner surface of outer shaft 6*b* and the outer surface of inner shaft 6*a*, with fins 17 extending from the outer surface of the inner shaft 6*a* towards the inner surface of the outer shaft 6*b*.

FIG. 3*a* corresponds to FIG. 2*a* and FIG. 3*b* is a sectional view in the plane III-III of FIG. 3*a*. In FIG. 3*a* the shaft 6 has been raised by the operation of the dispenser acting on flange 13, relative to the position shown in FIG. 2*a*. In FIG. 3*a*, the dispensing mechanism is partway through its dispensing cycle. The shaft 6 has moved to a position where the apertures 16 at the top of the closed channels 15 are no longer sealed by the O-ring 14, permitting liquid soap 3 compressed by the action of the piston 7 entering the first chamber 9, to be forced down the side of the first piston 7 and to enter into the channels 15 via the apertures 16.

Because the closed channels 15 are sealed at the bottom, the now pressurised liquid soap 3 is forced past the tips of the radially extending fins 17, distorting the fins and causing atomisation of the liquid as it is forced into adjacent channels (hereinafter referred to as open channels 22) as represented by arrows 18.

From FIGS. 3*a* and 3*b*, a central passage 19 is seen formed by the inner shaft 6*a* and outer shaft 6*b*. The lower end of passage 19 terminating at outlet 20. Located in the passage is a gauze 21.

Referring now to FIGS. 4*a* and 4*b*, these are corresponding views to FIGS. 3*a* and 3*b* at the same stage of operation, but with the dispenser mechanism rotated through 90°.

In FIGS. 4*a* and 4*b*, the open channels 22 are seen to be connected by apertures 23 to the second chamber 10 and by apertures 24 to the inner passage 19, such that as the second piston 8 compresses air within the chamber 10, the air is forced through the open channels 22 in the direction of arrows 25 and 26. Thus pressurised air is forced up the open channels 22 (out of the paper as shown in FIG. 4*b*) at the same time as the liquid soap 3 is forced past the tips of fins 17, as represented by the arrows 18 in FIG. 4*b*, to form a foam which travels down passage 19 via the gauze 21, which aggregates the foam bubble size, in the direction of arrow 27 and out through the outlet 20.

Figure 6A:
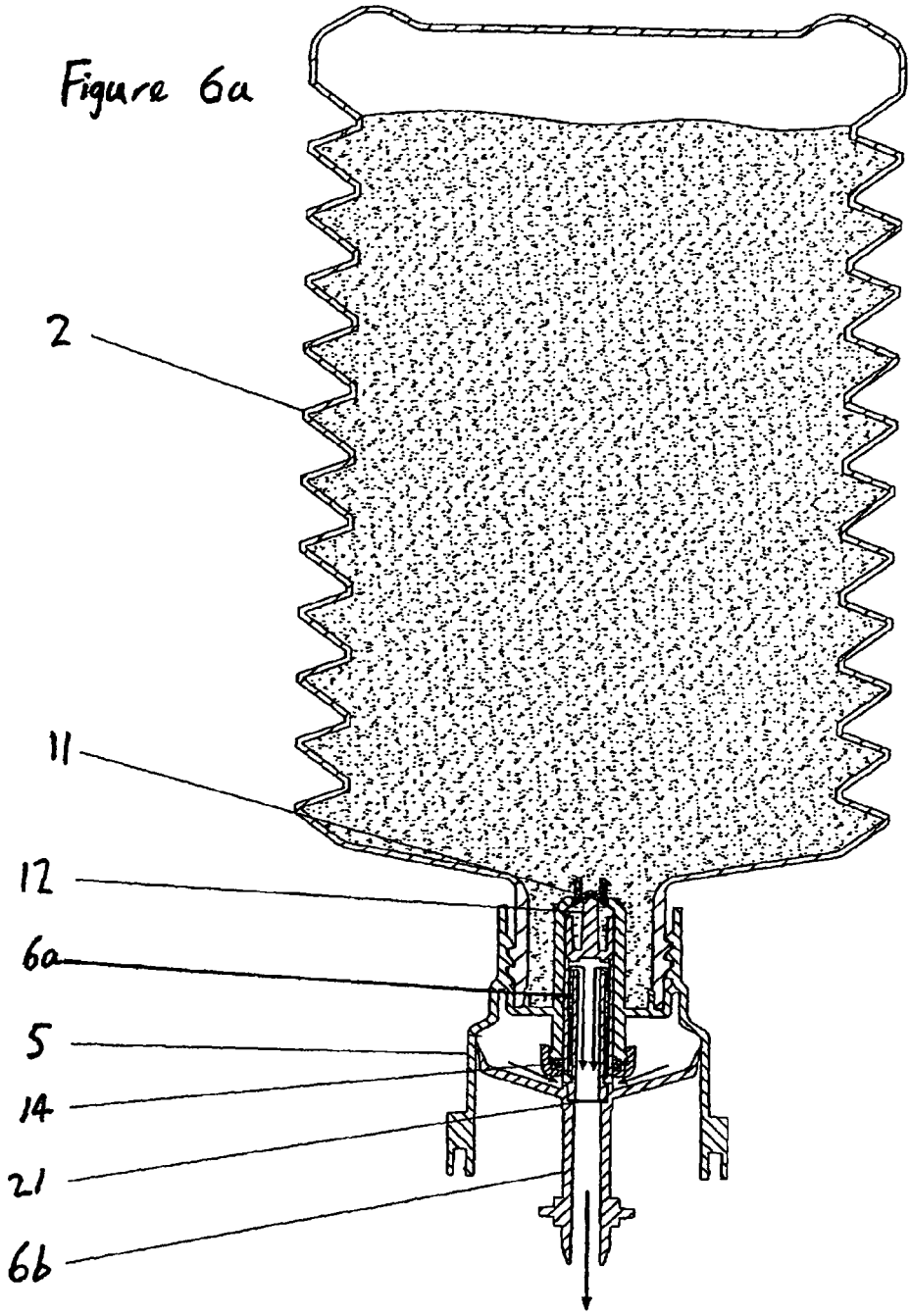
Figure 6B:
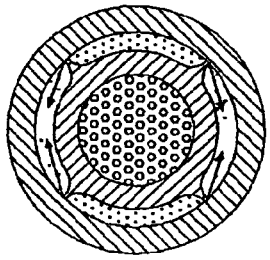

FIGS. 5*a* and 5*b* are corresponding views to those of FIGS. 3*a* and 3*b* but show the dispenser mechanism when the shaft 6 is fully depressed and reaches the limit of its travel. FIGS. 6*a* and 6*b* are corresponding views to FIGS. 5*a* and 5*b* but show the dispenser mechanism rotated through 90°.

Figure 7A:
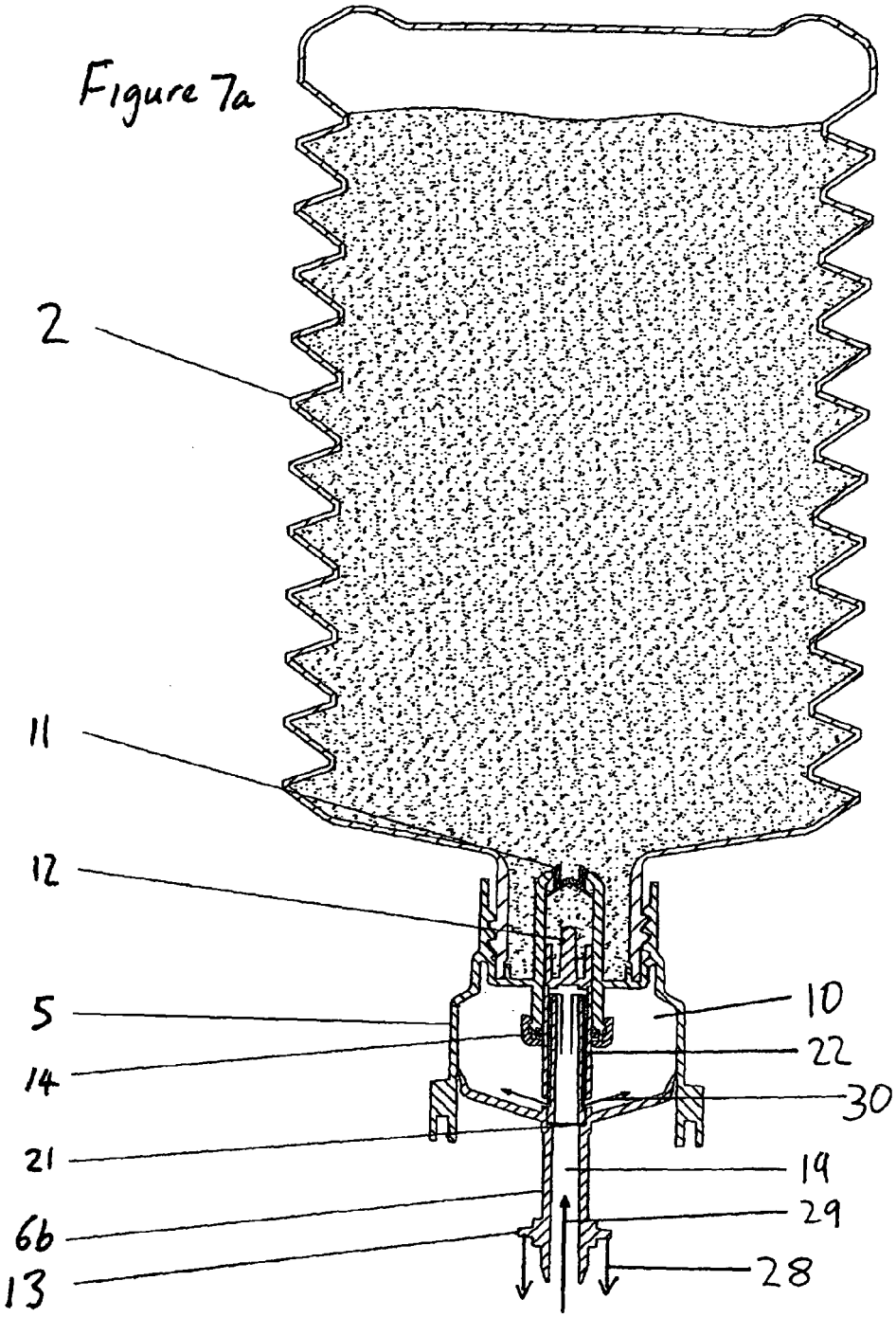
Figure 7B:
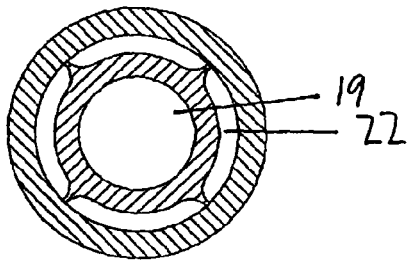

FIGS. 7*a* and 7*b* correspond to the set of FIGS. 4*a* and 4*b*, but show the dispensing mechanism 1 midway through its return stroke, the dispensing mechanism being acted upon by the dispenser (not shown) drawing flange 13 in the direction of arrows 28 back to its rest position. During this part of the cycle, the expanding volume within the second chamber 10 draws air into the second chamber through the passage 19 and open channels 22, as represented by arrows 29 and 30. This draws any foam remaining in the passage 19 back into the bottom of the chamber 10, from where it will be expelled back through the open channels at the start of the next dispensing cycle. This ensures that at the end of the dispensing cycle passage 19 is free of foam and thus will not drip as the foam reverts back to liquid.

As shown in FIG. 8, with subsequent dispensing actions the volume of liquid soap 3 within the container 2 will be reduced and the container will contract as shown.

Referring now to FIGS. 9 to 15, there is illustrated a second dispensing mechanism shown in its different stages of operation. This embodiment differs only from that illustrated and described with reference to FIGS. 1 to 8 in that the inner shaft 6*a* has a different configuration.

With the exception of the inner shaft 6*a* and the associated foaming chamber, the mechanism of FIGS. 9 to 15 functions in exactly the same manner as previously described with reference to FIGS. 1 to 8. For this reason, the following description of FIGS. 9 to 15, essentially describes only those aspects which differ from the embodiment previously described.

Referring to FIG. 9, the dispenser mechanism of the second embodiment is shown with the transport cap 4 in place. At the commencement of operation, the transport cap is removed and downward action on the flange 13 causes it to adopt the position shown in FIG. 10*a* and FIG. 10*b*, FIG. 10*b* being enlarged section showing the inner shaft 6*a* of FIG. 10*a*.

The inner shaft 6*a* has a central wasted section which defines a foaming chamber having a closed portion 41 and an open portion 42. These sections are separated by a disc shaped fin element 47, integrally formed with the inner shaft 6*a*. The outer dimension of the fin element 47 corresponds to the inner diameter of the upper portion of the outer shaft 6*b*.

Below the waisted region 41, 42 the inner shaft has a plurality of axially extending grooves (not shown) in its outer surface defining channels 44 connecting the open portion 42 of the foaming chamber to the second chamber 10 via apertures 23.

In the conical section 48 of the inner shaft 6*a*, a plurality of apertures 45 are formed connecting the open portion 42 of the foaming chamber to the open outlet 19 of the dispenser mechanism.

Above the closed portion 41 of the foaming chamber, a plurality of grooves 46 are formed in the external surface of the inner shaft 6*a* forming apertures extending between the closed portion 41 and the base of piston 7.

The action of moving the shaft 6*a*, 6*b* down fills the first chamber 9 with fluid drawn into the chamber 9 via non-return valve 11, as described with reference to the first embodiment. When in a "fully primed" state, as illustrated in FIG. 10*a*, the chamber 9 is sealed by piston 7 engaging with O-ring 14.

At commencement of the dispensing operation, the flange 13 is moved upwards to the position shown in FIG. 11, where the outer shaft 6*b* seals with O-ring 14. Continued raising of the shaft 6*a*, 6*b* causes the non-return valve 11 to seal the first chamber 9, as illustrated in FIGS. 12*a* and 12*b*. Now the closed portion 41 of the foaming chamber, together with grooves 46, the gap around the piston 7 and first chamber 9, define a closed volume filled with a substantially incompressible liquid. This same movement of the shaft 6*a*, 6*b* causes second piston 8 to displace air from the second chamber 10 forcing air in the direction of broken arrows 48 of FIG. 12*b*, into the open portion 42 of the foaming chamber. The air swirls about the open portion 42 of the chamber and exits via apertures 45 to the outlet passage 19. During this process, the pressure of the liquid in the closed portion 41 of the foaming chamber forces the tip of the fin element 47 to distort such that the liquid in the closed portion 41 is forced under pressure in the direction of arrows 49, atomising as it passes the tip of fin element 47 and mixing with the air flow, as indicated by arrows 50. This forms a foam which passes through the outlet passage in the direction of arrow 51.

The action described with reference to FIGS. 12*a* and 12*b* continues until the dispenser reaches the end of its stroke as illustrated in FIGS. 13*a* and 13*b*. At this point, the flange 13 is drawn downwards, increasing the volume of the second chamber 10 drawing foam in the outlet passage 19 back into the bottom of the second chamber 10, as represented by the arrows 52 of FIGS. 14*a* and 14*b*. At the same time, liquid is drawn into the first chamber 9 via non-return valve 11. This continues until piston 6 reaches the bottom of its stroke as illustrated in FIG. 15 with the container 2 collapsing as liquid 3 is removed from the container 2. The mechanism is this returned to it's "primed state" awaiting the next dispensing cycle.

Referring now to FIGS. 16 to 20, FIG. 16*a* is a side elevation of a wall mounted liquid soap dispenser 31 in accordance with a first aspect of the present invention, comprising a main unit having an actuator handle 37. FIG. 16*b* is a front sectional view through the dispenser 31. The dispenser 31 comprises a back plate 32 providing a mounting for the replaceable unit comprising dispenser mechanism 1 and container 2 of either FIGS. 1 to 8 or 9 to 15.

The components of dispensing mechanism 1 have been shown in restricted form in these figures and only illustrate those components necessary to understand the interrelationship with the linkage mechanism of the dispenser. The components shown could thus equally be those of the dispenser mechanism of FIGS. 1 to 8 or those of FIGS. 9 to 15.

Referring to FIGS. 16 to 20, the dispenser 31 has a linkage mechanism formed by main pillars 33, a main plate 34, a travelling plate 38, auxiliary pillars 39 and springs 35, 40.

The main pillars 33 are constrained and run in vertical bearing surfaces on the back plate 32. The pillars 33, located to either side of the dispenser, are attached to the main plate 34 as shown, with springs 35 acting between the main plate 34 and back plate 32 maintaining the main plate 34 in its lower position as shown.

Slots 36 in each of the main pillars 33 engage with pegs (not shown) of the actuator handle 37 of FIG. 16*a*, which handle provides a user interface by which a user may operate the dispenser. A user pressing the handle 37 causes the pegs of the handle to vertically raise the main pillars 33.

The travelling plate 38 is attached by auxiliary pillars 39, which auxiliary pillars 39 pass through holes in the main plate 33, with springs 40 acting between a shoulder on the top of the auxiliary pillars 39 and the main plate 34 to retain the travelling plate in an upper position next to the main plate 34, as shown. The travelling plate 38 is also attached to the flange 13 on the shaft 6 of the dispensing mechanism 1, such that the shaft 6 moves with the travelling plate 38.

Figures 17A, 17B:
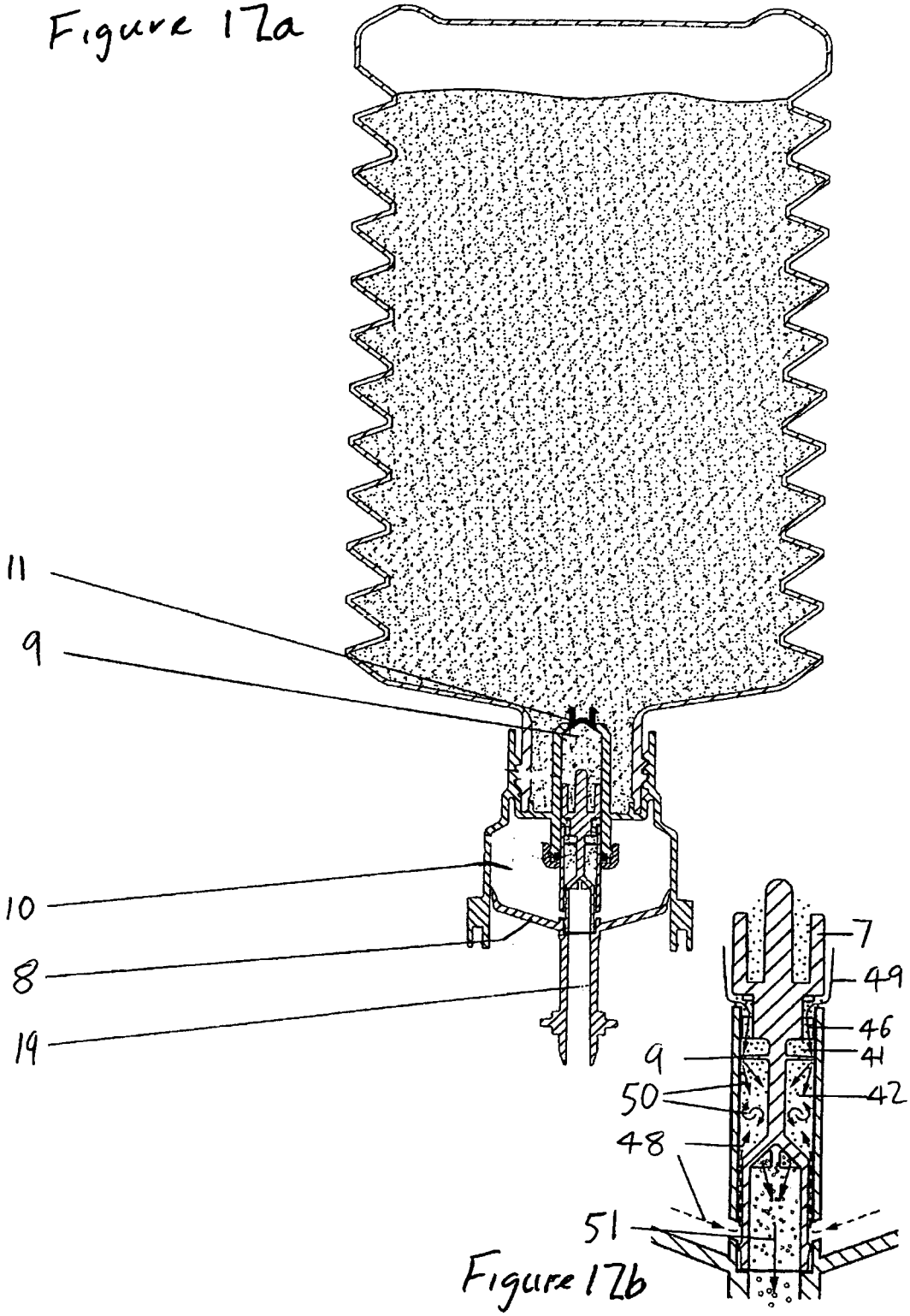

Referring now to FIGS. 17*a* and 17*b*, these correspond to those of FIGS. 16*a* and 16*b* but show the dispenser at full stroke, when the handle 37 has been fully depressed and is restrained by stops associated with the handle. The action of pressing the handle has raised the main pillars 33 to the position shown, whereby this in turn has raised the main plate 34, travelling plate 38 and shaft 6 to its fully raised position, dispensing a predetermined quantity of foam.

Figure 18A:
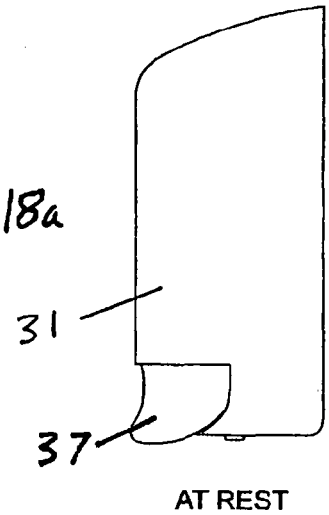
Figure 18B:
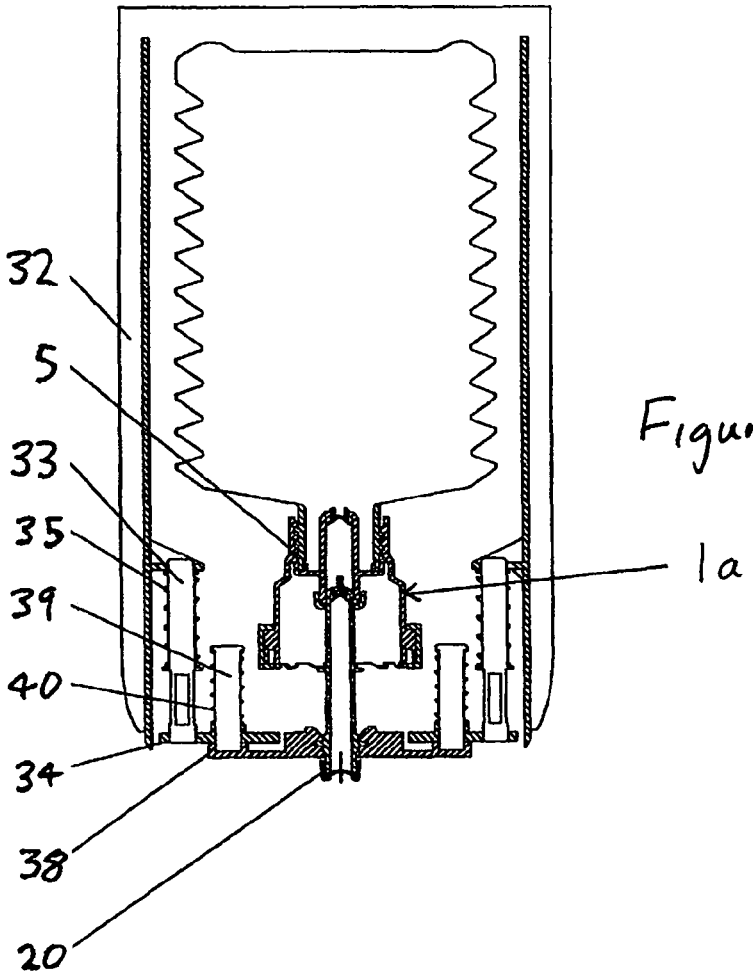
Figure 19A:
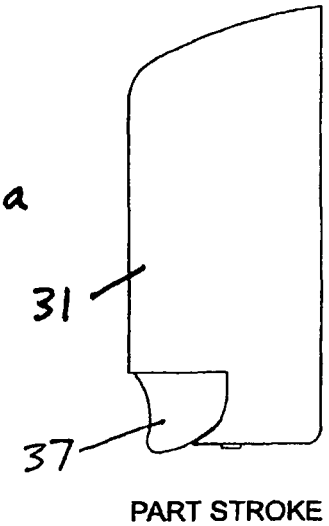
Figure 19B:
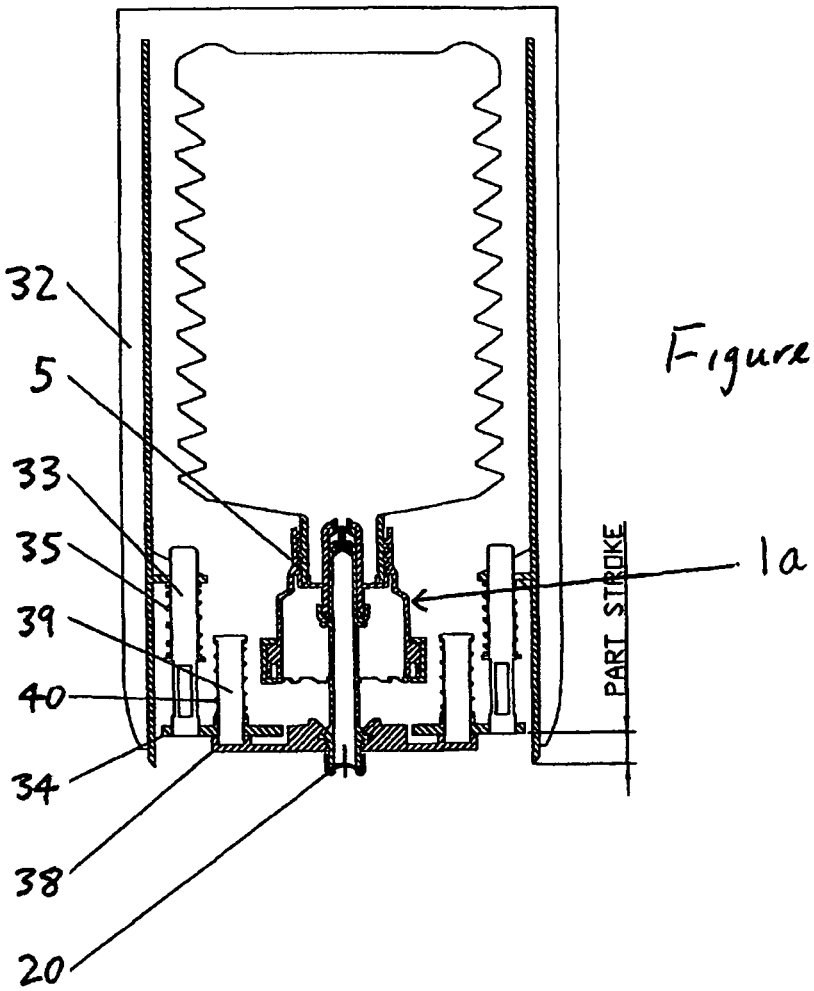
Figure 20A:
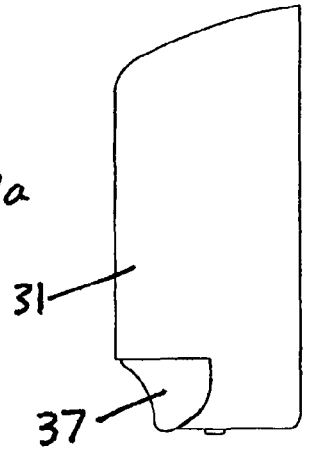
Figure 20B:
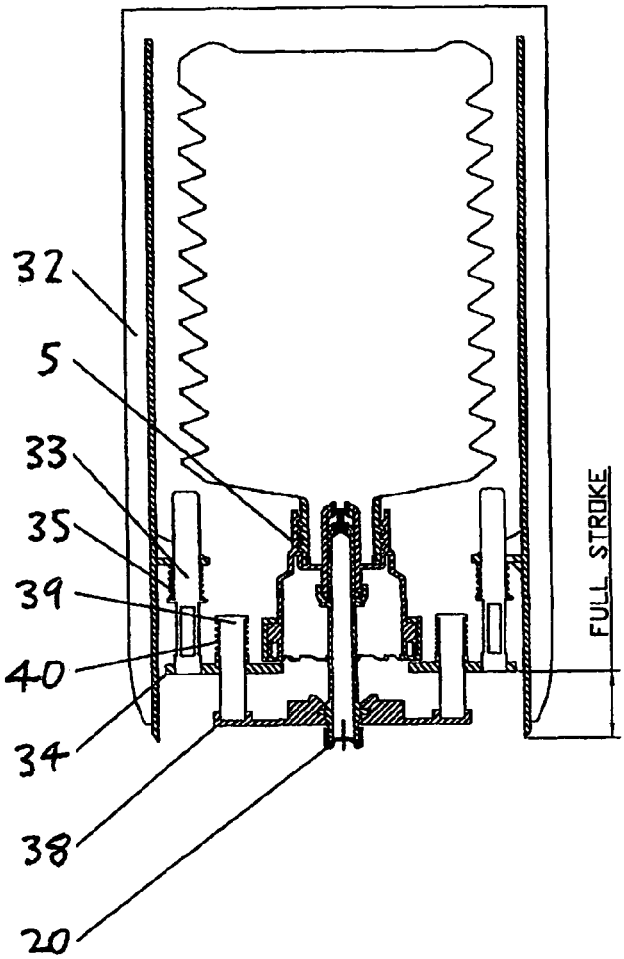

Referring to FIGS. 18*a* and 18*b*, there is shown the same dispenser 31 fitted with an alternative dispensing mechanism 1*a* which has a reduced operating stroke. The dispensing mechanism 1*a* is fitted to the dispenser 31, in the same manner as previously described with reference to FIGS. 16*a* to 17*b*. However, as shown in corresponding FIGS. 19*a* to 19*b*, partial depression of the handle 37 will complete a full stroke of the dispenser mechanism. If the handle 37 was directly linked to the dispenser mechanism 1*a*, then further force depression of the handle 37, which often occurs as a user will commonly "thump" the handle, would result in damage to the dispenser mechanism. However, as illustrated in FIGS. 20*a* and 20*b*, further depression of the handle 37, to complete a full stroke of the handle, causes the travelling plate 38 to move away from the main plate 34 against the force exerted by springs 40. Thus, the springs 40 act as a resilient means absorbing the extra displacement. This permits the dispenser 31 to be used with dispenser mechanisms having different full stroke lengths or may be arranged to permit the stroke length of the dispensing mechanism to be varied in order to control the quantity of foam, or other product to be dispensed.

In the embodiment depicted, the main pillars 33 and auxiliary pillars 39 are spatially separated for clarity, but these pillars and associated springs could equally be arranged in coaxial pairs.

Referring now to FIGS. 21*a* to 23*b*, these illustrate the initial operation of a dispenser 31 in accordance with a first aspect of the invention (as shown in FIGS. 16 to 20) when a replaceable unit, comprising container 2 (not shown) and dispenser mechanism 1, is inserted in the dispenser 31. When the replaceable unit is first inserted in the dispenser 31, pin 12 is pressed against non-return valve 11, maintaining valve 11 in place to prevent leakage during transport, with the shaft 6 in a fully raised position where it was previously retained by the transport cap (now removed).

Initial operation of the actuator handle 37, as shown in FIG. 22*a*, will cause travelling plate 38 to rise until spring biased clips 60 engage with flange 13. Then, (as shown in FIGS. 23*a* and 23*b*) when the actuator handle is released, the travelling plate 38 will lower drawing shaft 6 with it, leaving the dispensing mechanism 1 in a primed state.

Referring now to FIGS. 24*a* to 26*b*, here representations are provided equivalent to those described above with reference to FIGS. 21*a* to 23*b*, but with spring biased clips 60 of the previous figures replaced by spring biased clips 61, which have a ratchet surface 62 on their inner face.

In the embodiment depicted in FIGS. 24*a* and 24*b*, when the replaceable unit is first inserted in the dispenser 31, the flange 13 will initially adopt the position shown relative to the clips 61. Where the dispensing mechanism 1 is, what is termed a full stroke mechanism, operation of the actuator handle 37 (as shown in FIG. 25*a*) will cause the travelling plate 38 and associated clip 61 to be raised, (as shown in FIG. 25*b*) so that the flange 13 engages with a lower-most detent (63) of the ratchet 62. Thus when the actuator handle 37 is released (as shown in FIG. 26*a*) the shaft 6 will be lowered (as shown in FIG. 26*a*) to its fully primed position.

Referring to FIGS. 27*a* and 27*b*, a further alternative arrangement is shown. Here housing 5 has an annular protrusion (also known as a stop member) 64 moulded thereon, which protrusions engages with the travelling plate 38, restricting the stroke of the dispensing mechanism when the actuator handle is depressed, as shown in FIG. 28*a*. However, the flange 13 has at this stage has engaged with the first detent 65 of the ratchet 62, so that when the actuator handle 37 is released (as shown in FIG. 29*a*) the shaft 6 will be drawn partially down.

Although the purpose of the annular protrusion (stop member) 64 is to restrict the stroke of the dispenser mechanism and thus the quantity of product dispensed, by limiting movement of the shaft 6 of the dispensing mechanism 1, it will be realised from the previous description of the operation of the dispensing mechanisms illustrated in FIGS. 1 to 8 and 9 to 15, that unless the shaft 6 reaches the bottom of its stroke the dispensing mechanism will not function as it will not be primed.

Ratchet 62 overcomes this problem, for as illustrated in FIGS. 30*a* to 35*b*, reiterative operation of the actuator handle 37 will progressively cause successive detents of the ratchet 62 to engage with the flange 13, until the flange 13 adopts the position shown in FIG. 35*b*. In this position it is properly primed and at the start of a restricted actuating stroke. Thus the ratchet ensures that although operation occurs only over a restricted part of the stroke, due to the annular protrusion stop member) 64, the shaft 6 always eventually operate from its lowermost position, where the dispenser mechanism is correctly primed and where in the embodiments of FIGS. 1 to 8 and 9 to 15 the dispenser is prevented from leaking.

It will be seen that this arrangement enable dispensing mechanisms, for dispensing different volumes of product, to have common components, with the quantity dispensed by the dispensing mechanism 1 restricted merely by modifying the housing casing to add an annular protrusion (stop member). This can be achieved by, in the moulding process, for the casing, providing a recess corresponding to the annular protrusion (stop member) and placing an insert in the recess if the dispenser mechanism is to operate over its full stroke. Furthermore, different insertions can be used in the mould to provide annular protrusions (stop members) 64 of different depths, thereby providing dispenser mechanisms for providing a number of different quantities of product, but which mechanisms in all other respects are identical.

The invention has been described above by way of example only, but it will be appreciated that many alternative embodiments are possible within the scope of the appended claims. For example the "ratchet" could be on the dispenser mechanism, as this is a simple mechanical equivalent. Also, a stop member could take many different forms and could even be adjusted on installation of the replaceable unit, depending on a customers requirements.

The invention claimed is:

1. A manually operated single product dispenser comprising a user interface for receiving a single stroke actuation by a user, a single dispenser mechanism for dispensing a predetermined quantity of product to the user on a full stroke of the dispenser mechanism and a linkage mechanism for transferring displacement of the user interface to the dispenser mechanism, wherein the linkage mechanism permits the user interface to be operated to the full extent permitted by the user interface and to transmit to the dispenser mechanism only as much of the operation of the user interface as is required to permit the dispenser mechanism to dispense the predetermined quantity of product wherein the linkage mechanism comprises a first plate connected to the user interface and arranged to move with the user interface, a second plate connected to the dispenser mechanism, and at least one resilient member arranged to act between the first plate and the second plate, the resilient member being selected such that it will cause the first plate and the second plate to be displaced together in response to any movement of the user interface to cause the dispenser mechanism to be operated, but which when the dispenser mechanism reaches the end of its travel, permits the first plate to continue to be displaced while the second plate remains substantially stationary, thereby absorbing substantially any excess movement of the user interface to prevent damage to the dispenser mechanism.

2. A dispenser as claimed in claim 1, comprising a main unit including the linkage mechanism and a replaceable unit, the replaceable unit containing product to be dispensed and including the dispenser mechanism, wherein the linkage mechanism permits the main unit to be used with dispenser mechanisms having different maximum stroke lengths.

3. A manually operated product dispenser comprising:

a user interface for receiving a single stroke actuation by a user;

a replaceable unit, the replaceable unit containing product to be dispensed and including a dispenser mechanism for dispensing a predetermined quantity of the product to the user on a full stroke of the dispenser mechanism;

a main unit comprising a linkage mechanism for transferring displacement of the user interface to the dispenser mechanism, wherein the linkage mechanism comprises a first plate connected to the user interface and arranged to move with the user interface, a second plate connected to the dispenser mechanism, and at least one resilient member arranged to act between the first plate and the second plate, the resilient member being selected such that it will cause the first plate and the second plate to be displaced together in response to any movement of the user interface to permit the dispenser mechanism to dispense the predetermined quantity of product, but which when the dispenser mechanism reaches the end of its travel, permits the first plate to continue to be displaced while the second plate remains substantially stationary, wherein the linkage mechanism further permits the main unit to be used with dispenser mechanisms having different maximum stroke lengths; and a ratchet mechanism arranged such that after installation of a new replaceable unit having a dispenser mechanism with a particular maximum stroke length, the ratchet mechanism will, on subsequent operations of the user interface, cause the linkage mechanism to progressively engage with the dispenser mechanism until the dispenser mechanism adopts a correct operating position relative to the linkage mechanism, whereby operation of the user interface causes the dispenser mechanism to perform a desired stroke.

4. A manually operated product dispenser comprising:

a main unit housing a user interface for receiving a single stroke actuation by a user and a linkage mechanism; and a replaceable unit for storing product to be dispensed and having a dispenser mechanism for dispensing a quantity of product on actuation of the user interface, wherein the linkage mechanism comprises a first plate connected to the user interface and arranged to move with the user interface, a second plate connected to the dispenser mechanism, and at least one resilient member arranged to act between the first plate and the second plate, the resilient member being selected such that it will cause the first plate and the second plate to be displaced together in response to any movement of the user interface to cause the dispenser mechanism to be operated but which, when the dispenser mechanism reaches the end of its travel, permits the first plate to continue to be displaced while the second plate remains substantially stationary, and the dispenser further includes a ratchet mechanism arranged such that after installation of a new replaceable unit having a dispenser mechanism with a particular maximum stroke length, the ratchet mechanism will, on subsequent operations of the user interface, cause the linkage mechanism to progressively link with the dispenser mechanism so that the dispenser mechanism adopts a correct operating position relative to the linkage mechanism, whereby operation of the user interface causes the dispenser mechanism to perform a desired stroke.

5. A dispenser as claimed in claim 3 or 4, wherein the ratchet mechanism forms part of the linkage mechanism and wherein the dispenser mechanism comprises an engagement point which is engaged by one or more surfaces of the linkage mechanism.

6. A dispenser as claimed in claim 5, wherein said engagement point is on a nozzle of the dispenser mechanism which nozzle forms a dispensing nozzle of the dispenser.

7. A dispenser as claimed in claim 2 or 4, wherein the replaceable unit comprises a number of types of replaceable units that can be used with a common main unit, the replaceable units comprising dispenser mechanisms which are substantially the same as each other but wherein at least some of the dispenser mechanisms include a stop member to provide dispenser mechanisms with different maximum stroke lengths, with the replaceable units arranged so that they can be transported in a closed state and then, in operation, extend to a primed state wherein the dispenser mechanism is fully extended against the at least one said stop member.

8. A dispenser as claimed in claim 1 or 4, wherein the dispenser mechanism comprises:

a liquid chamber arranged to receive a liquid product; an air chamber arranged to receive air; an actuator mechanism arranged to simultaneously pressurize contents of both the liquid chamber and the air chamber; a foaming chamber; and at least one fin separating an open portion of the foaming chamber from a closed portion of the foaming chamber, wherein the dispenser mechanism is arranged such that operation of the actuator mechanism causes the open portion to receive air from the air chamber and guide said air to an outlet of the dispenser mechanism and the closed portion to simultaneously receive pressurized liquid from the liquid chamber, the at least one fin being dimensioned such that liquid in the closed portion is forced, under pressure, past the tip of the fin to the open portion where said liquid is mixed with air flowing in the open portion to form a foamed product.

9. A dispenser as claimed in claim 8, wherein the actuator mechanism comprises a first piston and a second piston on a common shaft, each of the first piston and the second piston acting on a respective one of the liquid chamber and the air chamber.

10. A dispenser as claimed in claim 9, wherein a first chamber is a cylinder into which the first piston extends to pressurize the contents of the chamber and wherein the foaming chamber is in the first piston.

11. A dispenser as claimed in claim 8, wherein the actuator mechanism is biased to a primed position where a piston associated with each respective chamber is withdrawn to a maximum extent from its respective chamber.

12. A dispenser as claimed in claim 11, wherein in the primed position the liquid chamber is sealed by its associated piston.

13. A range of dispenser mechanisms for use with a dispenser as claimed in claim 1 or 4, the dispenser mechanisms having identical components except for stop members which differ for dispenser mechanisms of different types to determine the quantity of product dispensed on full stroke operation.

14. A wall mounted soap dispenser arranged to permit single handed one stroke operation comprising a dispenser as claimed in claim 1 or 4.

* * * * *